US008985582B2

(12) United States Patent
Igarashi

(10) Patent No.: US 8,985,582 B2
(45) Date of Patent: Mar. 24, 2015

(54) SHEET PROCESSING APPARATUS, METHOD FOR CONTROLLING SHEET PROCESSING APPARATUS, AND STORAGE MEDIUM

(71) Applicant: Canon Kabushiki Kaisha, Tokyo (JP)

(72) Inventor: Hiroya Igarashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/912,799

(22) Filed: Jun. 7, 2013

(65) Prior Publication Data

US 2013/0334771 A1 Dec. 19, 2013

(30) Foreign Application Priority Data

Jun. 14, 2012 (JP) ..... 2012-134841

(51) Int. Cl.

| | |
|---|---|
| ***B65H 39/10*** | (2006.01) |
| ***B65H 31/24*** | (2006.01) |
| ***B65H 31/10*** | (2006.01) |
| ***B65H 31/22*** | (2006.01) |
| ***B65H 43/06*** | (2006.01) |
| ***G03G 15/00*** | (2006.01) |

(52) U.S. Cl.

CPC ..... *B65H 31/24* (2013.01); *B65H 31/10* (2013.01); *B65H 31/22* (2013.01); *B65H 43/06* (2013.01); *G03G 15/6538* (2013.01); *B65H 2301/134* (2013.01); *B65H 2301/42252* (2013.01); *B65H 2405/15* (2013.01); *B65H 2405/312* (2013.01); *B65H 2511/10* (2013.01); *B65H 2511/51* (2013.01); *B65H 2801/06* (2013.01)

USPC ..... 271/298; 270/52.03; 270/58.18; 270/58.14

(58) Field of Classification Search

USPC ..... 271/298; 270/52.03, 58.18, 58.14

See application file for complete search history.

(56) References Cited

U.S. PATENT DOCUMENTS

| | | | | |
|---|---|---|---|---|
| 6,257,572 | B1 * | 7/2001 | Yamada et al. | 271/305 |
| 8,459,643 | B2 * | 6/2013 | Cheng | 271/288 |
| 2012/0001387 | A1 * | 1/2012 | Mutsuno | 271/298 |

FOREIGN PATENT DOCUMENTS

JP 2000-094808 A 4/2000

* cited by examiner

*Primary Examiner* — David H Bollinger

(74) *Attorney, Agent, or Firm* — Canon USA, Inc., IP Division

(57) ABSTRACT

The present invention is directed to providing a mechanism for allowing a user to easily take out print products discharged onto a plurality of sheet discharge trays in the discharge order. A control method for controlling a sheet processing apparatus for performing control to discharge sheets onto a plurality of sheet discharge trays includes storing, in a storage unit, the discharge order in which sheets have been discharged onto equal to or more than two sheet discharge trays by executing a job, and performing, upon reception of a take-out instruction for taking out in the discharge order the sheets discharged by executing the job, processing for allowing a user to take out the sheets discharged onto the equal to or more than two sheet discharge trays, in the discharge order stored in the storage unit.

9 Claims, 24 Drawing Sheets

MASS STACKER 1

MASS STACKER 2

FIG.21A

| | PRESENCE OF SHEET | SHEET SIZE |
|---|---|---|
| STACKER TRAY A | NONE | — |
| STACKER TRAY B | NONE | — |
| STACKER TRAY C | NONE | — |
| STACKER TRAY D | NONE | — |

FIG.21B

| | PRESENCE OF SHEET | SHEET SIZE |
|---|---|---|
| STACKER TRAY A | NONE | — |
| STACKER TRAY B | NONE | — |
| STACKER TRAY C | PRESENT | A4 |
| STACKER TRAY D | NONE | — |

FIG.21C

| | PRESENCE OF SHEET | SHEET SIZE |
|---|---|---|
| STACKER TRAY A | PRESENT | — |
| STACKER TRAY B | PRESENT | — |
| STACKER TRAY C | PRESENT | A4 |
| STACKER TRAY D | PRESENT | B5 |

FIG.21D

| | PRESENCE OF SHEET | SHEET SIZE |
|---|---|---|
| STACKER TRAY A | PRESENT | A3 |
| STACKER TRAY B | PRESENT | A3 |
| STACKER TRAY C | PRESENT | A4 |
| STACKER TRAY D | PRESENT | A4 |

SHEET PROCESSING APPARATUS, METHOD FOR CONTROLLING SHEET PROCESSING APPARATUS, AND STORAGE MEDIUM

BACKGROUND OF THE INVENTION

1. Field of the Invention

The present invention relates to a sheet processing apparatus, a method for controlling the sheet processing apparatus, and a storage medium.

2. Description of the Related Art

There has conventionally been a sheet processing apparatus which has a plurality of sheet discharge trays, and discharges print products onto any one of the sheet discharge trays.

Such a sheet processing apparatus discharges print products onto a sheet discharge tray and, when the sheet discharge tray becomes tray-full, continues discharging remaining print products onto another sheet discharge tray. Even if the sheet discharge tray is not tray-full, this sheet processing apparatus can also divide print products to discharge thereof onto another sheet discharge tray for the purpose of sorting.

When print products are separately discharged onto a plurality of sheet discharge trays, it is difficult for a user to recognize the discharge order of the print products discharged onto the plurality of sheet discharge trays. Regularly, the user does not constantly keep monitoring print products being discharged onto the plurality of sheet discharge trays to confirm the discharge order.

Japanese Patent Application Laid-Open No. 2000-094808 discusses a technique for printing on a notification sheet the discharge order of print products separately discharged onto a plurality of sheet discharge trays, and attaching the notification sheet to print products discharged onto the respective sheet discharge trays.

However, when dividing print products to discharge thereof onto a plurality of sheet discharge trays with the conventional method, a user cannot recognize the discharge order of print products discharged onto the plurality of sheet discharge trays unless the user refers to the notification sheet. In this case, since notification sheets are required, sheets will be wasted. Further, after confirming the discharge order, the user must carefully make take-out instruction according to notification sheets.

SUMMARY OF THE INVENTION

According to an aspect of the present invention, a sheet processing apparatus for performing control to discharge sheets onto a plurality of discharge trays includes a storage unit configured to store discharge order of a plurality of sheets separately discharged onto equal to or more than two sheet discharge trays by executing a job, and a control unit configured to, upon reception of a take-out instruction for taking out in the discharge order the sheets discharged by executing the job, perform processing for allowing a user to take out the plurality of sheets discharged onto the equal to or more than two sheet discharge trays, in the discharge order stored in the storage unit.

Further features and aspects of the present invention will become apparent from the following detailed description of exemplary embodiments with reference to the attached drawings.

BRIEF DESCRIPTION OF THE DRAWINGS

FIGS. 21A, 21B, 21C, and 21D illustrate a stacking status table according to an exemplary embodiment of the present invention.

DESCRIPTION OF THE EMBODIMENTS

The following describes exemplary embodiments of the present invention with reference to accompanying drawings.

Figure 1:
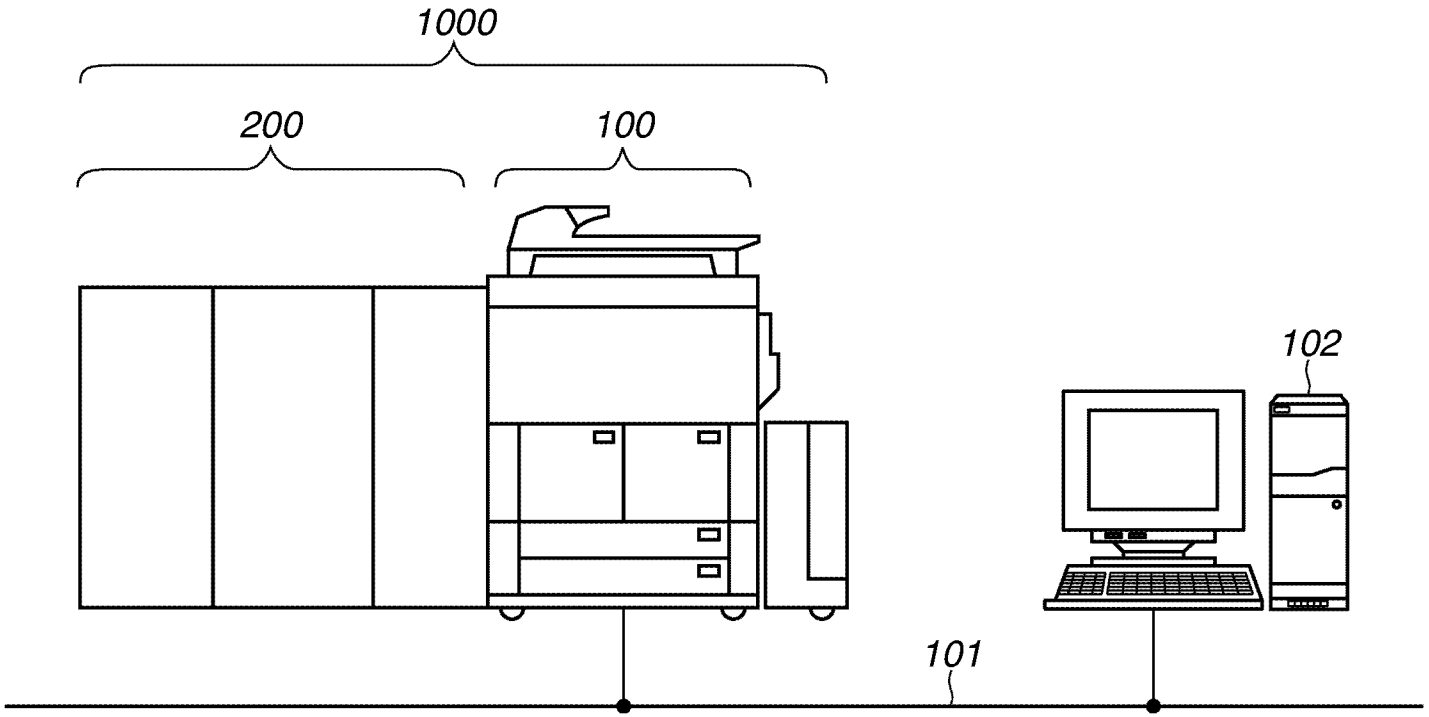
FIG. 1 illustrates a configuration of a system according to an exemplary embodiment of the present invention.

FIG. 1 illustrates an example configuration of a system according to an exemplary embodiment of the present invention. A printing system according to the present exemplary embodiment includes a printing system 1000 and a PC 102 as an example of an external apparatus. The printing system 1000 and the PC 102 are connected via a network 101. The network 101 may be any one of a wired local area network (LAN), a wireless LAN, and the Internet.

The PC 102 is provided with application software for generating image data. The PC 102 transmits the image data to the printing system 1000 via a printer driver in response to an instruction received from a user.

The PC 102 also checks the status of the printing system 1000 via the network 101.

The printing system 1000 includes a printing apparatus 100 and a sheet processing apparatus 200, receives print data from the PC 101, and prints an image on a sheet according to the print data. The printing system 1000 further includes a scanner, and prints on a sheet an image of a document read by the scanner.

Although, in the present exemplary embodiment, the printing system 1000 and the PC 102 are connected via the network 101, they may be connected via a local interface, such as a universal serial bus (USB) interface, or via a wireless network.

Figure 2:
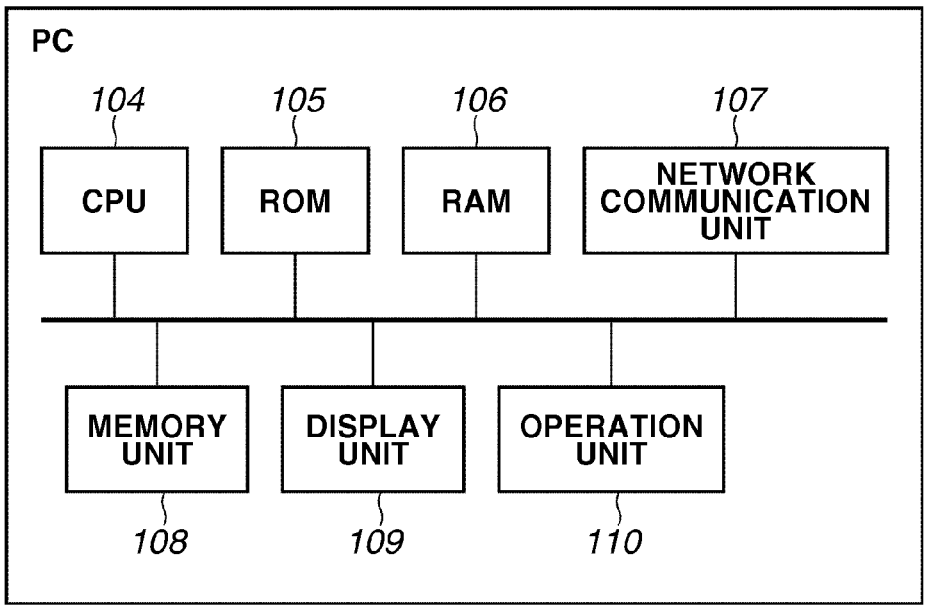
FIG. 2 illustrates a configuration of a personal computer (PC) according to an exemplary embodiment of the present invention.

The following describes a configuration of the PC 102 with reference to FIG. 2.

The PC 102 includes a central processing unit (CPU) 104, a read-only memory (ROM) 105, a random access memory (RAM) 106, a network communication unit 107, a storage unit 108, a display unit 109, and an operation unit 110 which are mutually connected via a bus.

The CPU 104 reads a program (for example, application software, the printer driver, etc.) from the ROM 105, and then executes it. The ROM 105 stores various programs to be read by the CPU 104.

The RAM 106 stores data and programs and is used mainly as a work memory for the CPU 104.

The network communication unit 107 performs interface control of data transmitted and received via the network 101.

The storage unit 108 is a nonvolatile memory, such as a hard disk drive (HDD). The storage unit 108 stores programs and image data generated by the above-described application software.

The display unit 109, such as a liquid crystal display (LCD) unit and a cathode ray tube (CRT) display unit, displays various operation screens and messages.

The operation unit 110, such as a keyboard, a mouse, and a touch panel, receives an operation performed by the user on the PC 101.

The PC 102 generates print data by the printer driver based on the image data generated by application software, and transmits the generated print data, together with print settings, to the printing system 1000 via the network 101. The PC 102 also receives status information and a print result of the printing system 1000 from the printing system 1000, and displays the received status information and print result on the display unit 109.

Figure 3:
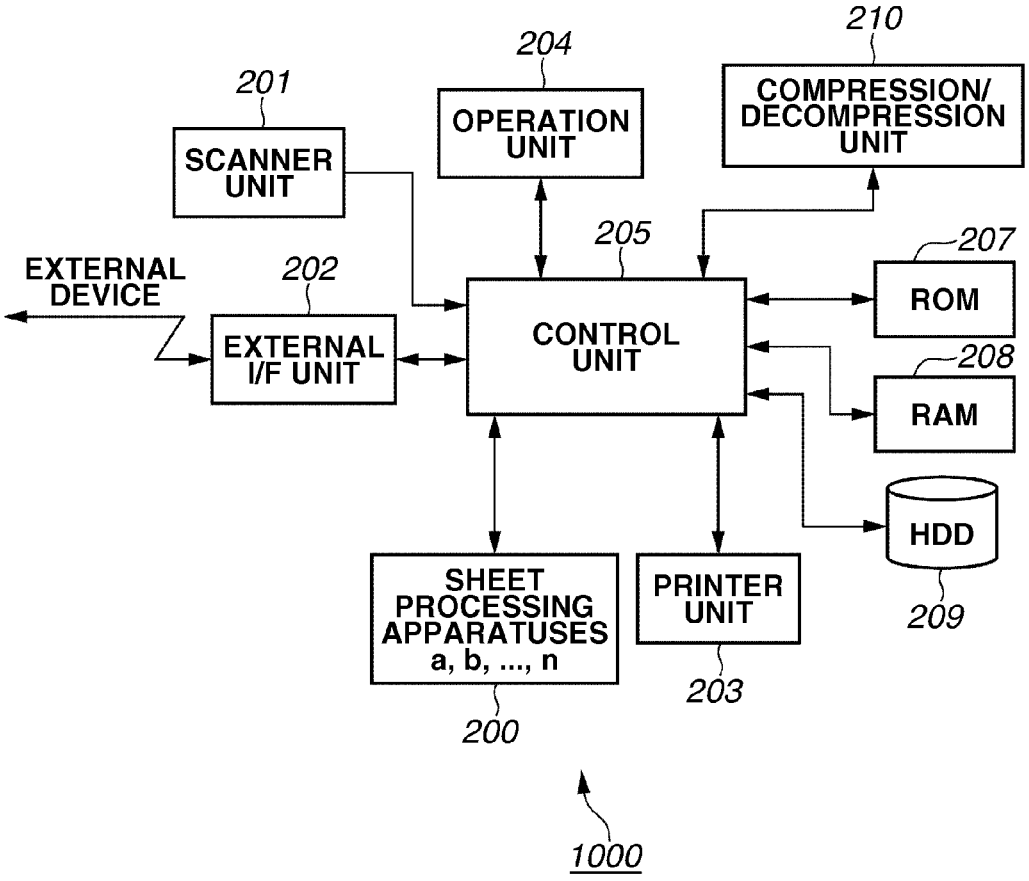
FIG. 3 illustrates a configuration of a printing system according to an exemplary embodiment of the present invention.

The following describes a configuration of the printing system 1000 with reference to FIG. 3.

The printing system 1000 includes a scanner unit 201, an external interface (I/F) unit 202, a printer unit 203, an operation unit 204, a control unit 205, a ROM 207, a RAM 208, and an HDD 209. These components are connected via an internal bus of the printing system 1000.

The control unit 205 reads a program stored in the ROM 207 and then executes the program to totally control the printing system 1000.

The scanner unit 201 reads a document, generates image data of the read document, and transmits the generated image data to the control unit 205.

The external I/F unit 202 controls data transmission and reception to/from the external network 101. For example, the external I/F unit 202 receives image data transmitted from an external apparatus, such as the PC 102, and transmits the image data to the control unit 205. The external I/F unit 202 also transmits data received from the control unit 205 to an external apparatus, such as the PC 102, via the network 101. As described above, the network 101 may be a local interface or a wireless network.

The printer unit 203 prints an image on a sheet based on the image data received from the control unit 205 and the print settings (a print layout, number of print copies, and other print information) received from the control unit 205. The printer unit 203 includes motors and rollers for conveying a sheet (not illustrated).

The operation unit 204 includes a display, a touch panel, hardware keys, etc. The operation unit 204 displays an operation screen on the display, and receives a user's instruction from the touch panel provided on the display unit. The operation unit 204 also receives a user's instruction via the hardware keys. The operation unit 204 transfers the received instruction to the control unit 205.

The ROM 207 stores programs to be executed by the control unit 205.

The RAM 208 serves as a work memory for the control unit 205, and temporarily stores a program read from the ROM 207 and image data.

The HDD 209 is a nonvolatile storage medium. The HDD 209 stores data of a job to be performed together with the order to be executed.

For example, when executing a copy job, the control unit 205 stores in the HDD 209 as a copy job the image data read by the scanner unit 201 in association with the print settings received via the operation unit 204, and executes the stored copy job. The control unit 205 executes the copy job, and instructs the printer unit 203 to print the image data stored in the HDD 209, based on the print settings stored in association with the relevant image data.

Further, when executing a print job, the control unit 205 stores in the HDD 209 as a copy job the image data received via the external I/F unit 202 in association with the print settings, and executes the stored print job. The control unit 205 executes the print job stored in the HDD 209, and instructs the printer unit 203 to print the image data stored in the HDD 209 based on the print settings stored in association with the relevant image data.

The HDD 209 stores a plurality of jobs. The control unit 205 performs the plurality of stored jobs in the reception order.

A compression/decompression unit 210 compresses or decompresses image data stored in the RAM 208 or the HDD 209, by using various compression methods, such as Joint Bi-level Image Experts Group (JBIG) and Joint Photographic Experts Group (JPEG).

Figure 4:
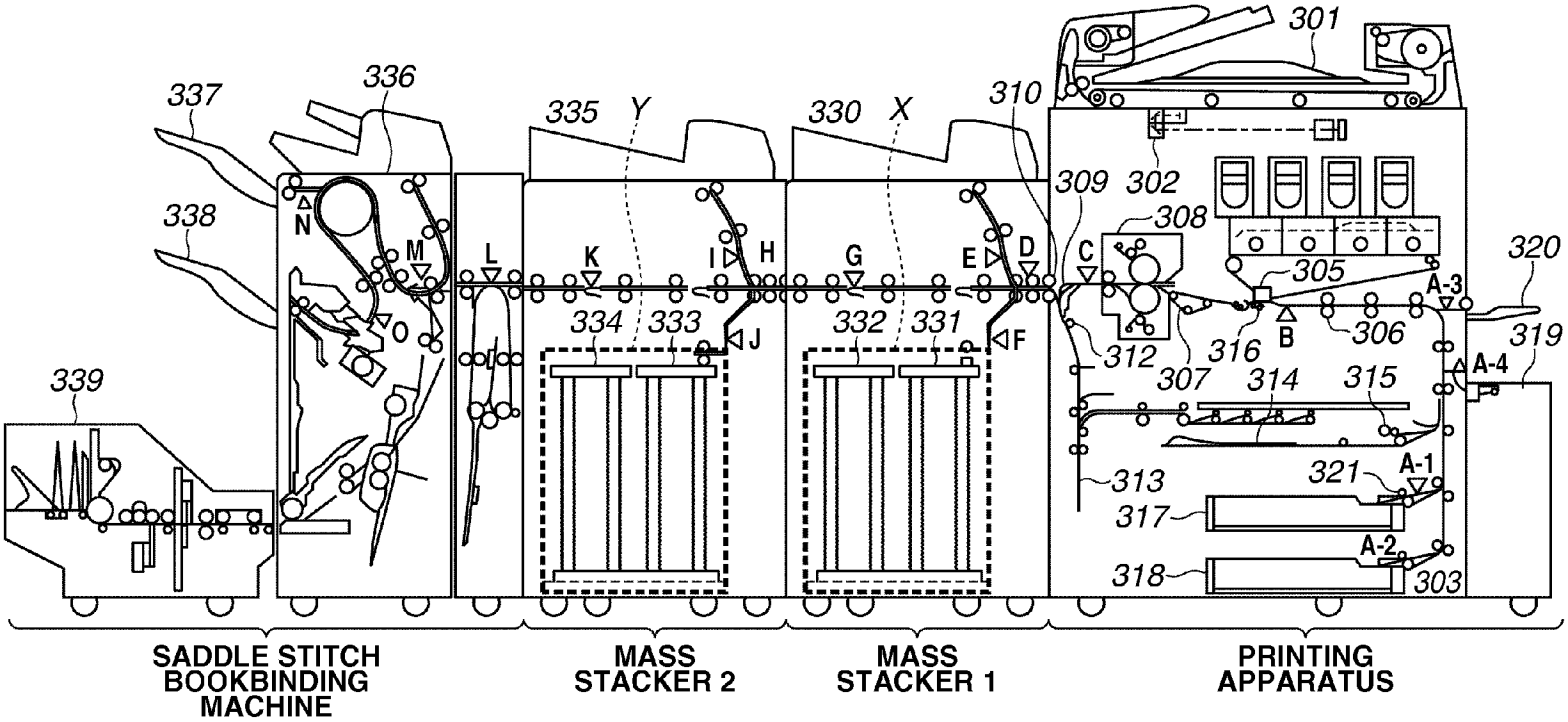
FIG. 4 illustrates a configuration of the printing system according to an exemplary embodiment of the present invention.

As illustrated in FIG. 4 (described below), the sheet processing apparatus 200 is connected with the printing apparatus 100 to apply sheet processing, such as sheet stacking and saddle stitch bookbinding, to sheets printed by the printing apparatus 100. The sheet processing apparatus 200 includes motors and rollers for conveying a sheet (not illustrated). The sheet processing apparatus 200 further includes motors and rollers for performing sheet processing (not illustrated).

The following describes the printing system 1000 with reference to the cross sectional view illustrated in FIG. 4. The following describes the configuration as well as the operation of the printing system 1000 when executing a copy job.

An automatic document feeder (ADF) 301 provided on the scanner unit 201 sequentially separates a plurality of sheets set on a document tray by the user, from a first sheet, and conveys the document sheet onto a document positioning glass plate. By using a charge-coupled device (CCD), a reading unit 302 reads an image of the document sheet conveyed onto the document positioning glass plate, and generates relevant image data. The generated image data is stored in a memory, such as the RAM 208 and the HDD 209, by the control unit 205.

The printing apparatus 100 is a tandem type color printer including a plurality of photosensitive members (drums). The printing apparatus 100 is provided with paper feed units (sheet accommodating units), such as sheet cassettes 317 and 318 and a manual feed tray 320, and feeds a sheet from any one of these paper feed units. The printing apparatus 100 is also provided with a paper feed deck 319 connected thereto as a paper feed unit, capable of accommodating a large volume of sheets. Sheets can be fed from the paper feed deck 319.

When a sheet fed from any one of the paper feed units is conveyed to a registration roller pair 306, the printing apparatus 100 once stops the sheet to achieve synchronization with an intermediate transfer belt 305. When there is a sheet waiting for transfer at the position of the registration roller pair 306, a sheet for printing the next page can be fed from any one of the sheet cassettes 317 and 318, the paper feed deck 319, and the manual feed tray 320. Feeding paper in this way enables shortening the conveyance interval of a plurality of sheets, thus improving the productivity of printing.

Meanwhile, image data temporarily stored in the RAM 206 and the HDD 208 is transmitted to the printer unit 207, and then converted into recording laser beams of respective four colors (yellow (Y), magenta (M), cyan (C), and black (K)), by a laser recording unit (not illustrated). Then, the photosensitive members for respective colors are irradiated with the recording laser beams to form electrostatic latent images of the respective colors on the photosensitive members. Then, toner development is performed by using toner of 4 colors supplied from toner cartridges to form respective toner images. The visualized toner images are primarily transferred from the photosensitive members onto the intermediate transfer belt 305 to form a 4-color toner image.

The intermediate transfer belt 305 rotates in the clockwise direction at a constant speed. When the intermediate transfer belt 305 has rotated up to a predetermined position, the control unit 205 starts conveying the sheet which has been waiting at the position of the registration roller pair 306. The predetermined position refers to a position where, when the leading edge of the toner image transferred onto the intermediate transfer belt 305 arrives at a secondary transfer position 316, an approximate end of the sheet is conveyed to the secondary transfer position 316. Thus, at the secondary transfer position 316, the toner image on the intermediate transfer belt 305 is transferred onto the sheet.

The sheet having the toner image transferred thereon is further conveyed by a belt 307, subjected to the application of pressure and heat by a fixing unit 308 to fix the toner, conveyed along the sheet conveyance path, and then discharged.

A sheet discharge flapper 309 is configured to be rotatable centering on a rotating shaft to restrict the sheet conveyance direction. When the sheet discharge flapper 309 rotates in the clockwise direction viewed in the figure and then is fixed at the relevant position, the sheet discharged from the fixing unit 308 is horizontally conveyed as it is, and then conveyed to a mass stacker 1 (one of the sheet processing apparatuses 200) by a sheet discharge roller pair 310. One-sided printing is performed in this way.

On the other hand, in the case of two-sided printing, the sheet discharge flapper 309 rotates in the counterclockwise direction viewed in the figure and then is fixed at the relevant position, a sheet discharged from the fixing unit 308 is downwardly directed and then sent to a two-sided conveyance unit. The two-sided conveyance unit includes a reversing flapper 311, a reversing roller 312, a reversing guide 313, and a two-sided tray 314. The reversing flapper 311 rotates centering on a rotating shaft to restrict the sheet conveyance direction. In the case of two-side printing, the control unit 205 performs control to rotate the reversing flapper 311 in the counterclockwise direction viewed in the figure to send the sheet having an image printed on the first side to the reversing guide 313 via the reversing roller 312. Then, the control unit 205 stops the reversing roller 312, with the trailing edge of the sheet pinched by the reversing roller 312 provided at the entrance of the reversing guide 313, and subsequently rotates the reversing flapper 311 in the clockwise direction viewed in the figure to rotate the reversing roller 312 in the reverse direction. Thus, the control unit 205 conveys the sheet on a switchback basis, i.e., the control unit 205 performs control to guide the sheet to the two-sided tray 314 with the leading and trailing edges interchanged.

The sheet is once supported by the two-sided tray 314 and then conveyed again to the registration roller pair 306 by a paper re-feed roller 315. In this case, the sheet is conveyed with the second side facing the intermediate transfer belt 305 (the second side is the side opposite to the first side on which toner has been transferred in the above-described first-side transfer process). Then, the control unit 205 forms an image on the second side of the sheet in a similar way to the above-described first-side transfer process. Then, after the fixing unit 308 has fixed the image formed on the second side of the sheet, the sheet discharge roller pair 310 conveys the sheet having the image formed thereon to the mass stacker 1 (one of the sheet processing apparatuses 200). Two-side printing is performed in this way.

The sheet having an image printed on one side or on both sides by the printing apparatus 100 is selectively conveyed to any one of the mass stacker 1, a mass stacker 2, and a saddle stitch bookbinding machine (the sheet processing apparatuses 200) based on the print settings set from the operation unit 203.

When sheets are to be discharged onto the mass stacker 1, a sheet having an image printed thereon by the printing apparatus 100 is conveyed to the mass stacker 1. The mass stacker 1 discharges the received sheet onto a stacker tray 331 or 332. The mass stacker 1 can also discharge the received sheet onto an escape tray 330. When sheets are to be discharged onto the mass stacker 2, a sheet having an image printed thereon by the printing apparatus 100 is conveyed to the mass stacker 2 via the sheet conveyance path of the mass stacker 1. The mass stacker 2 discharges the received sheet onto a stacker tray 333 or 334. The mass stacker 2 can also discharge the received sheet onto an escape tray 335.

When sheets are not to be discharged onto the mass stackers 1 and 2, the sheet having an image printed thereon by the printing apparatus 100 is conveyed to the saddle stitch bookbinding machine via the sheet conveyance path of the mass stackers 1 and 2. When no post-processing is set to be performed, the saddle stitch bookbinding machine discharges the received sheet onto the sheet discharge unit 337 via the sheet conveyance path 336.

When stapling is set to be performed, the saddle stitch bookbinding machine stores the received sheet in an intermediate tray via the sheet conveyance path 336. Then, when sheets to be stapled as one bundle have been prepared in the intermediate tray, the saddle stitch bookbinding machine applies stapling to the sheets for one bundle, and discharges the bundled sheets onto a sheet discharge unit 338.

When saddle stitch bookbinding is set to be performed, the saddle stitch bookbinding machine applies saddle stitch bookbinding to received sheets, and discharges the bound sheets onto a sheet discharge unit 339.

The printing system 1000 performs paper feeding, printing, post-processing, and sheet discharge processing in this way.

In the printing system 1000, each of the sheet conveyance paths of the printing apparatus 100, the mass stacker 1, the mass stacker 2, and the saddle stitch bookbinding machine is provided with a sheet detection sensor. Specifically, a sheet detection sensor is provided at the entrance and exit of each apparatus, and branching points and junction points of the sheet conveyance paths. Referring to FIG. 4, example positions of sheet detection sensors A to O are indicated by triangular marks. The control unit 205 receives signals from the sheet detection sensors A to O to detect the presence or absence of a sheet being conveyed through the respective sheet conveyance paths, and the position of the sheet.

For example, if a signal from a certain sheet detection sensor continues for a predetermined time period, the control unit 205 determines that a sheet retention jam has occurred at the position corresponding to the relevant sheet detection sensor. Alternatively, if a sheet that has passed a certain sheet detection sensor does not pass the following sheet detection sensor within a predetermined time period, the control unit 205 determines that a sheet delay jam has occurred between the relevant two sheet detection sensors.

If a sheet jam occurs in a sheet conveyance path of the printing system 1000, the control unit 205 interrupts printing and then displays as a guidance the position of a sheet which should be removed and procedures for removing the sheet based on a signal from the relevant sheet detection sensor. Thus, the user can recognize where in the printing system 1000 the sheet which should be removed exists, open a door of an apparatus according to the guidance, and remove the sheet from the sheet conveyance path.

Although, in the present exemplary embodiment, the printing apparatus 100 is a four-drum (4D) type color multifunctional peripheral (MFP), the printing apparatus 100 is not limited thereto, and may be a monochrome MFP or a one-drum (1D) type color MFP. The operation and configuration of the printing system 1000 has specifically been described above based on a copy job. However, in the case of a print job, the control unit 205 performs a similar print operation with this configuration by using print data from the external I/F unit 202 instead of image data from the scanner unit 201.

Figure 5:
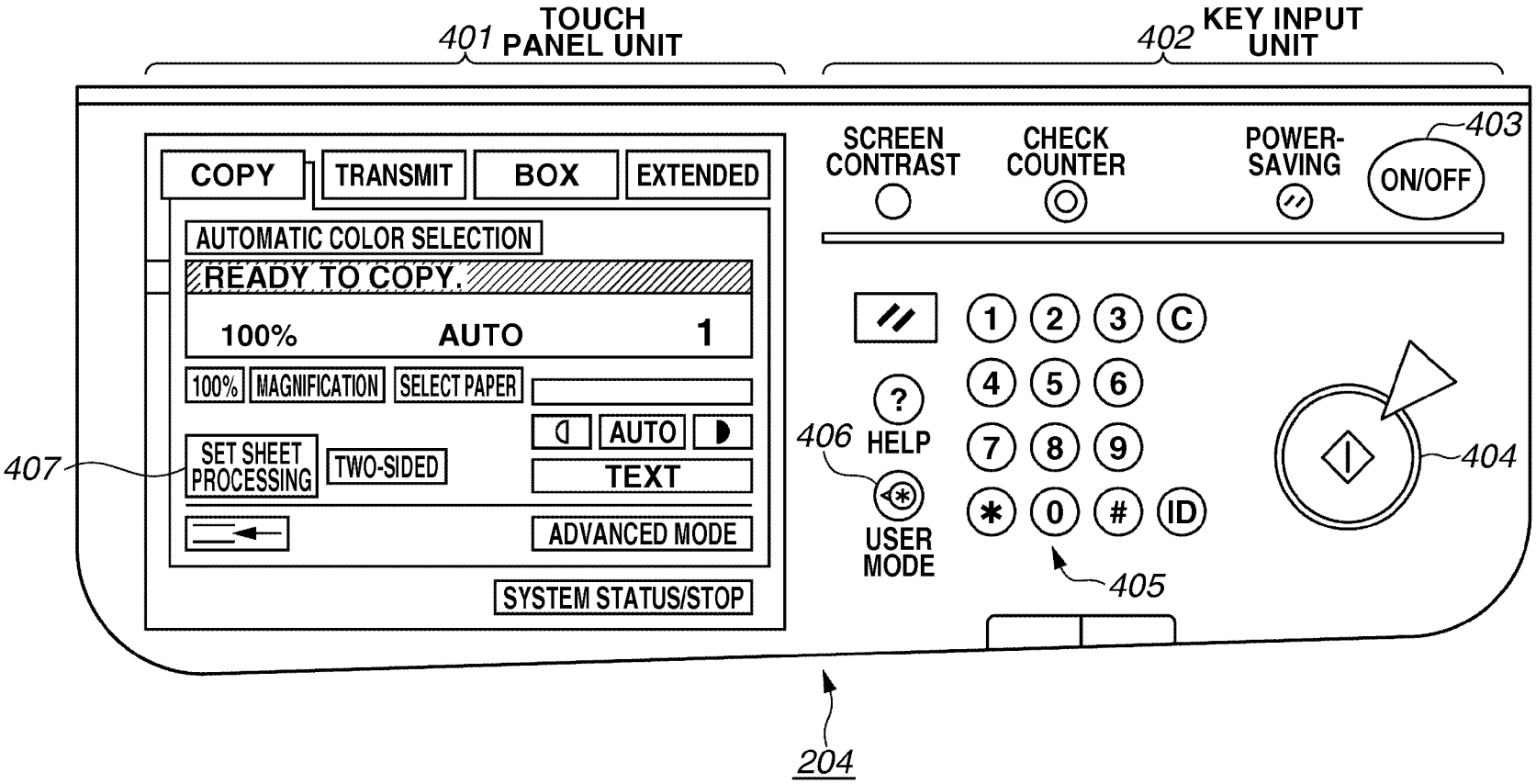
FIG. 5 illustrates a configuration of an operation unit according to an exemplary embodiment of the present invention.

FIG. 5 illustrates a configuration of the operation unit 204.

The operation unit 204 includes a touch panel unit 401 provided with software keys, and a key input unit 402 configured with hardware keys.

The touch panel unit 401 includes a liquid crystal display (LCD) unit and a touch panel attached thereon. The touch panel unit 401 receives an instruction from the user, and displays various messages to notify the user of information.

When the user presses the COPY tab of the touch panel unit 401, an operation screen for the copy function is displayed. When the user presses the TRANSMIT tab, an operation screen for data transmission functions, such as fax and E-mail transmission, is displayed. When the user presses the BOX tab, an operation screen for the box function is displayed on a display 401. The box function refers to a function of storing in the HDD 209 image data read by the scanner unit 201, selecting print data stored in the HDD 209 at a desired timing, and instructing the printer unit 203 to print the selected print data.

A power switch 403 is a button for switching between two different operating modes of the printing system 1000: the standby mode (a normal operating state) and the sleep mode (state of reducing power consumption while programs are deactivated in an interrupt wait state for being prepared for network printing, facsimile, etc.).

The START key 404 is used to instruct the printing system 1000 to start the copy operation and transmit operation.

The numeric keypads 405 are used to set the number of copies and input a password.

The USER MODE key 406 is used to make various settings for the printing system 1000.

The SET SHEET PROCESSING key 407 is used to set sheet processing to be performed by the sheet processing apparatus 200. When the user presses the SET SHEET PROCESSING key 407, the control unit 205 displays on the touch panel unit 401 the screen illustrated in FIG. 6.

Figure 6:
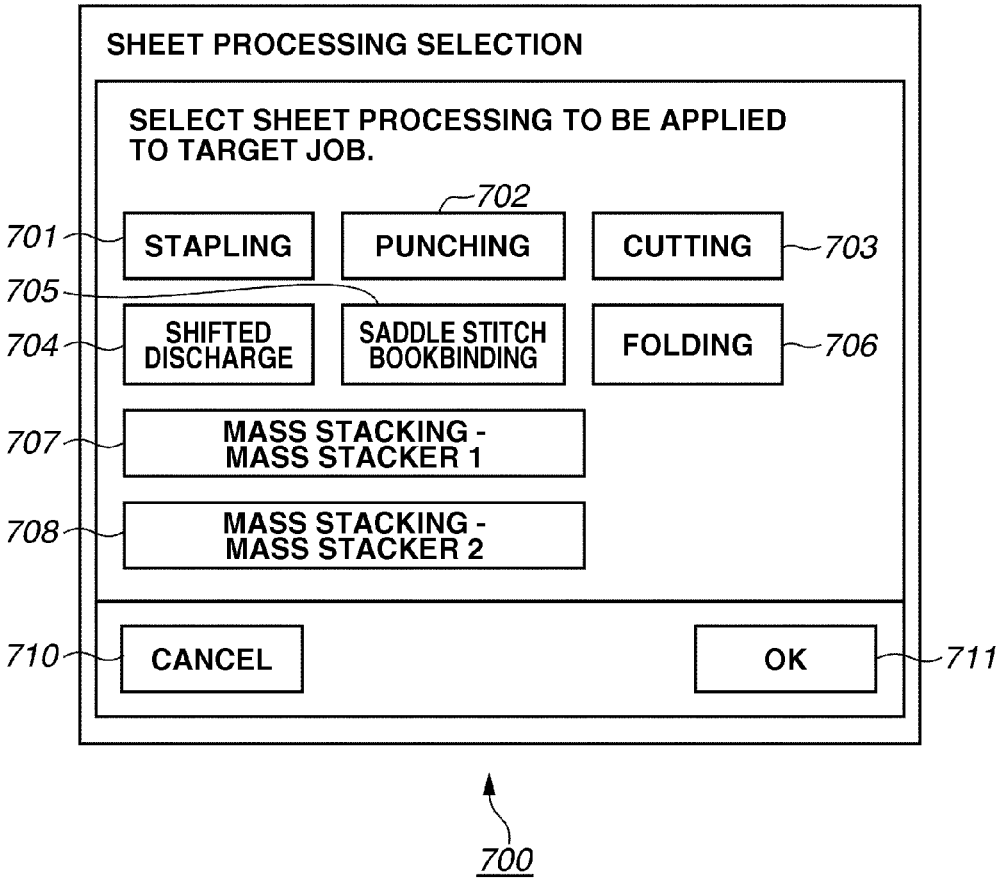
FIG. 6 illustrates an operation screen according to an exemplary embodiment of the present invention.

The screen illustrated in FIG. 6 displays buttons for receiving settings of sheet processing executable by the printing system 1000. Types of executable sheet processing are changed depending on the configuration of the printing system 1000.

FIG. 6 illustrates keys for performing the following processing.

(1) Stapling (key 701)
(2) Punching (key 702)
(3) Cutting (key 703)
(4) Shift sheet discharge (key 704)
(5) Saddle stitch bookbinding (key 705)
(6) Folding (key 706)
(7) Mass stacking (keys 707 and 708)

The control unit 205 performs control to apply selected sheet processing from (1) to (7) to the sheets printed by the printing apparatus 100.

For example, with the key 705 selected in the copy function, when the user presses the OK key 711 and then the START key 404, the control unit 205 reads a document via the scanner unit 201. Then, the control unit 205 prints image data of the read document based on the print settings received via the operation unit 204. Then, the control unit 205 conveys the printed sheet to the saddle stitch bookbinding machine illustrated in FIG. 4, and instructs the saddle stitch bookbinding machine to perform saddle stitch bookbinding.

Further, with the key 707 selected in the copy function, when the user presses the OK key 711 and then the START key 404, the control unit 205 reads a document via the scanner unit 201. Then, the control unit 205 prints image data of the read document based on the print settings received via the operation unit 204. Then, the control unit 205 conveys the printed sheet to the mass stacker 1 illustrated in FIG. 4, and instructs the mass stacker 1 to perform mass stacking. However, when sheets cannot be stacked onto the mass stacker 1, the printed sheet is conveyed to the mass stacker 2 and then stacked onto the mass stacker 2.

Further, with the key 708 selected in the copy function, when the user presses the OK key 711 and the START key 404, the control unit 205 reads a document via the scanner unit 201. Then, the control unit 205 prints image data of the read document based on the print settings received via the operation unit 204. Then, the control unit 205 conveys the printed sheet to the mass stacker 2 illustrated in FIG. 4, and instructs the mass stacker 2 to perform mass stacking. However, when sheets cannot be stacked onto the mass stacker 2, the printed sheet is conveyed to the mass stacker 1 and then stacked onto the mass stacker 1.

Mass Stacker

Figure 7A:
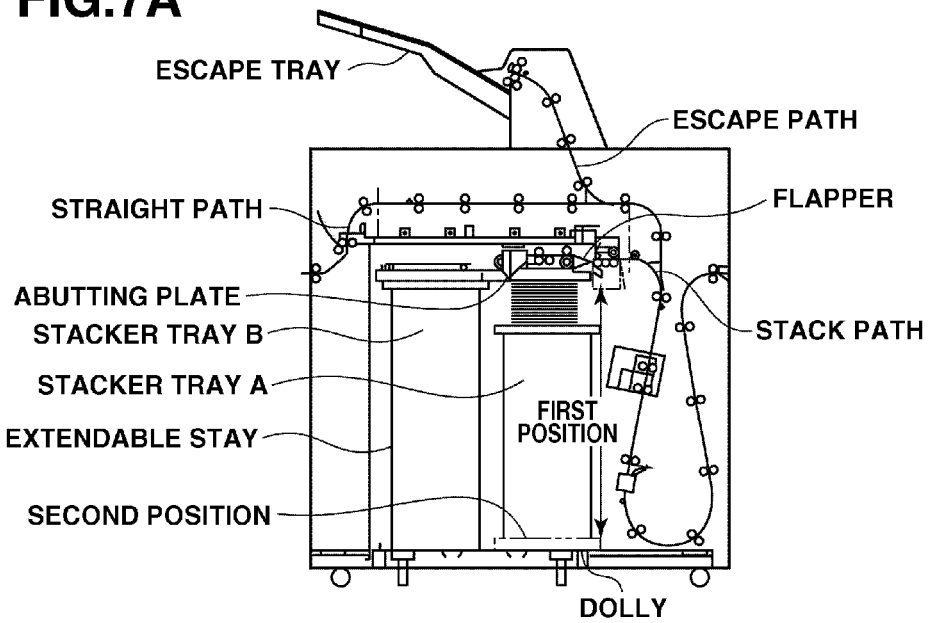
FIGS. 7A and 7B illustrate a configuration of a mass stacker according to an exemplary embodiment of the present invention.

FIG. 7A is a cross sectional view illustrating the mass stacker 1. The mass stacker 1 includes two stacker trays (corresponding to the stacker trays 331 and 332 illustrated in FIG. 4). In the following descriptions, the stacker tray closest to the sheet discharge slot of the stack path is referred to as stacker tray A, and the other stacker tray is referred to as stacker tray B.

Figure 7B:
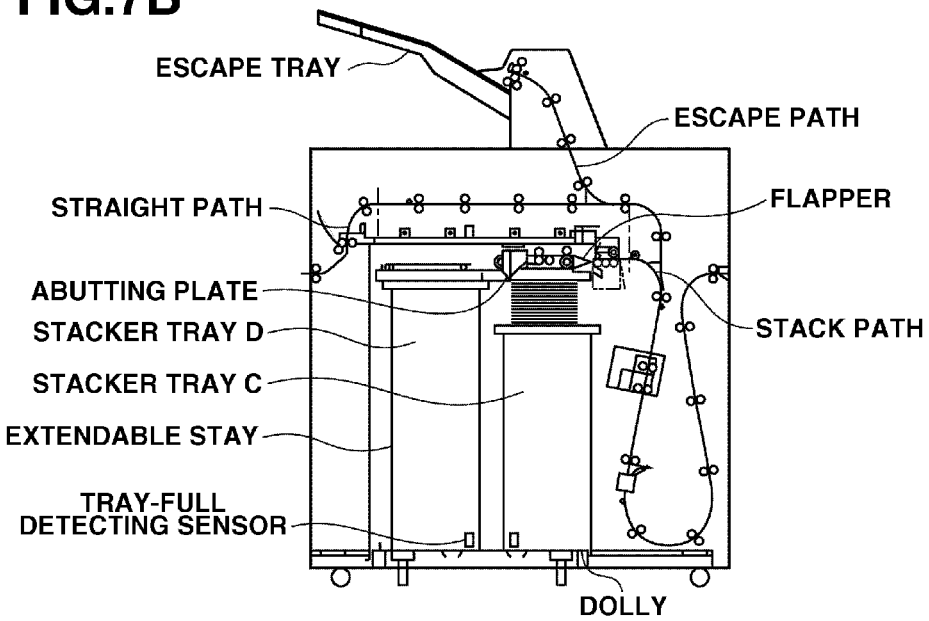

FIG. 7B is a cross sectional view illustrating the mass stacker 2. The mass stacker 2 also includes two stacker trays (corresponding to the stacker trays 333 and 334 illustrated in FIG. 4). In the following descriptions, the stacker tray closest to the sheet discharge slot of the stack path is referred to as stacker tray C, and the other stacker tray is referred to as stacker tray D.

FIGS. 7A and 7B illustrate example configurations of the mass stackers 1 and 2, respectively. The form of the sheet conveyance path is not limited to the one illustrated in FIGS. 7A and 7B, and may be the form of the sheet conveyance path of the mass stacker illustrated in FIG. 4.

Each mass stacker includes a straight path, an escape path, and a stack path.

The straight path is a sheet conveyance path for conveying a sheet conveyed from the apparatus (the printing apparatus 100 in the present exemplary embodiment) in a previous-stage to the apparatus (the saddle stitch bookbinding machine in the present exemplary embodiment) in a latter-stage. For example, a sheet printed by executing a job set to execute saddle stitch bookbinding is conveyed to the saddle stitch bookbinding machine in a latter-stage via the straight path.

The escape path is a sheet conveyance path for conveying a sheet to an escape tray.

The stack path is a sheet conveyance path for conveying a sheet printed by executing a job set to stack onto each mass stacker, to stack it onto a stacker tray.

According to an instruction from the control unit 205, the mass stacker switches between the stacker trays A and B on which a sheet discharged from the stack path is to be stacked, by using the flapper illustrated in FIG. 7A. When stacking a sheet on the stacker tray A, the sheet is guided to the stacker tray A under the conveyance belt by the flapper and then discharged onto the stacker tray A. When stacking a sheet on the stacker tray B, the sheet is guided above the conveyance belt by the flapper to discharge the sheet onto the stacker B and then discharged onto the stacker tray B by the conveyance belt.

When sheets are to be stacked onto the stacker tray A, the control unit 205 performs control to move the abutting plate to the position of the stacker tray A, and stack sheets onto the stacker tray A in an aligned way. Otherwise, when sheets are to be stacked onto the stacker tray B, the control unit 205 performs control to move the abutting plate to the position of the stacker tray B, and stack sheets onto the stacker tray B in an aligned way.

Figure 8:
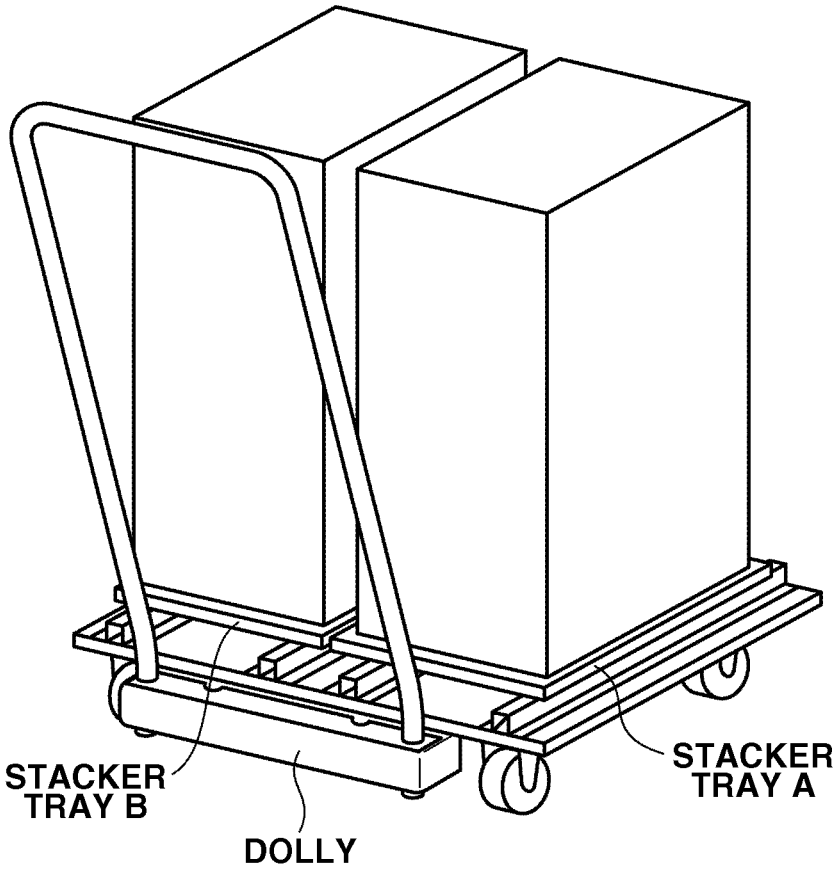
FIG. 8 illustrates a dolly according to an exemplary embodiment of the present invention.

Each mass stacker includes two stacker trays. Each of the two stacker trays is placed on an extendable stay so as to be elevatable. Each stacker tray is raised to a first position at which a sheet can be received, and lowered to a second position on the dolly by a extendable stay, and then set onto the dolly. The first position changes within a range indicated by the arrow illustrated in FIG. 7A, and is determined by the amount of the sheets stacked on the stacker tray. Referring to FIG. 7A, the stacker tray A exists at a position where the upper surface of the sheets stacked on the stacker tray A can stably support a sheet discharged from the stack path. This position is referred to as the first position. The second position refers to a position surrounded by the dotted lines illustrated in FIG. 7A, at which the stacker tray is set onto the dolly. The dolly can be provided with a handle, as illustrated in FIG. 8. The dolly is used by the user to carry sheets to another sheet processing apparatus.

Each mass stacker is provided with two front doors (covers) which can be opened and closed to enable the user to take out the sheets stacked on each stacker tray. When an instruction for opening the front door of the dolly is made, each stacker tray is lowered and then set onto the dolly. Then, with each stacker tray set on the dolly, each stacker tray together with the dolly is attached to each mass stacker. When the dolly has been attached to the mass stacker, each stacker tray is raised to a position where a sheet discharged from the stack path can be easily stacked. When no sheet exists on a stacker tray, the stacker tray is raised to a height at which the upper surface of the stacker tray can receive a sheet discharged from the stack path. Otherwise, when sheets have already been stacked on a stacker tray, the stacker tray is raised to a height at which the uppermost surface of the sheets stacked on the stacker tray can receive a sheet discharged from the stack path. After sheets have been stacked, upon reception of a sheet take-out instruction from the user, the stacker tray is lowered to a position (second position) at which the user can take out the sheets discharged onto the stacker tray.

Figure 9:
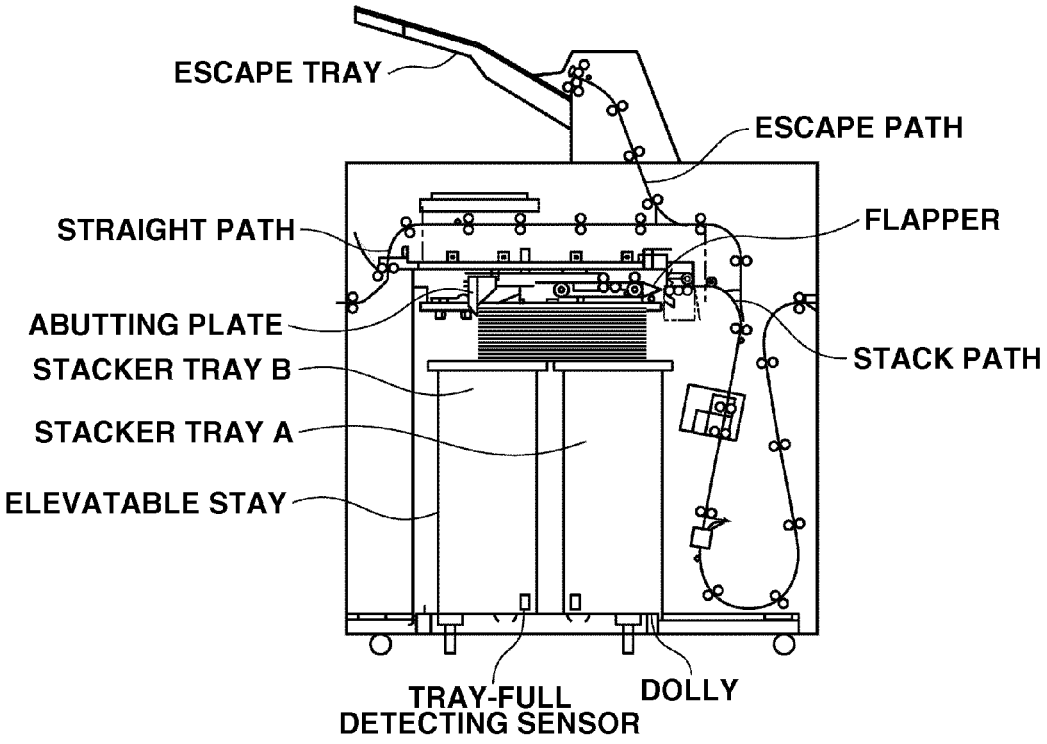
FIG. 9 illustrates a configuration of a mass stacker according to an exemplary embodiment of the present invention.

The mass stacker 1 can discharge sheets over the two stacker trays, as illustrated in FIG. 9. This also applies to the mass stacker 2. In this case, a sheet is guided toward the downward conveyance path by the flapper. In this case, the control unit 205 performs control to move the abutting plate according to the sheet size, and stack sheets onto the stacker trays A and B in an aligned way. For example, when the width of a sheet to be discharged in the sheet conveyance direction is larger than the width of one stacker tray, the control unit 205 performs control to discharge sheets over the two stacker trays. When discharging sheets over the two stacker trays, a leading edge of the first sheet may be guided onto the stacker tray B by a pinching unit provided on the abutting plate to prevent the sheet from entering a gap between the stacker trays A and B.

In the following descriptions, a sheet having a width in the sheet conveyance direction larger than the width of one stacker tray is referred to as a large-size sheet. Further, a sheet having a width in the sheet conveyance direction equal to or smaller than the width of one stacker tray is referred to as a small-size sheet.

Figure 10:
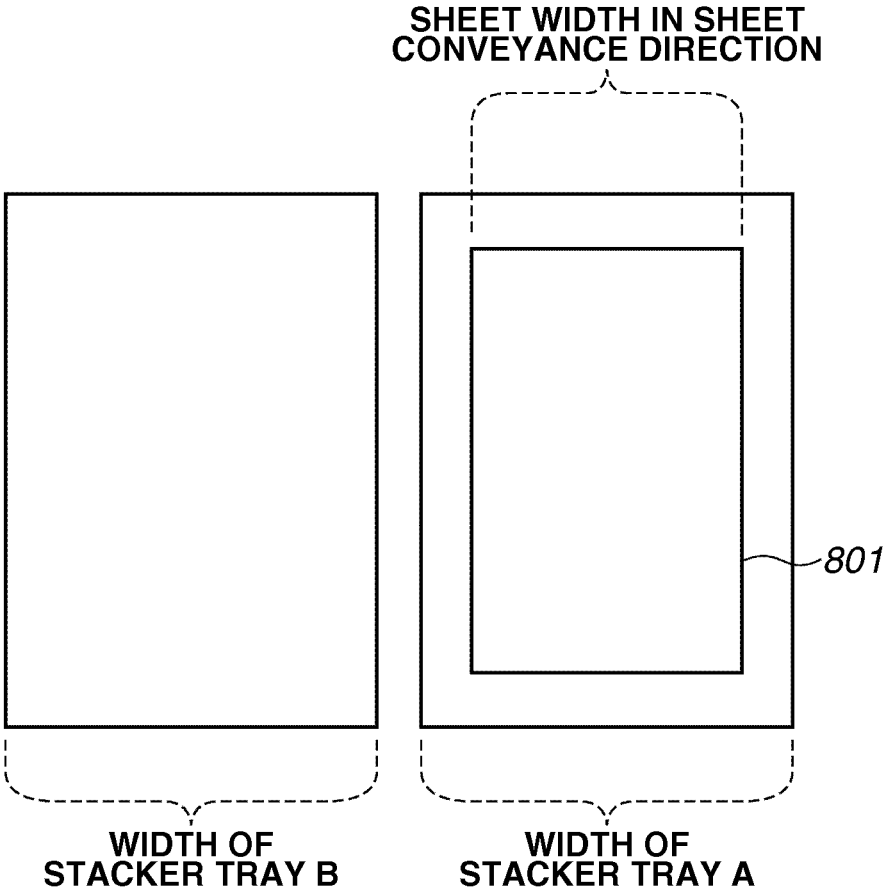
FIG. 10 illustrates stacker trays according to an exemplary embodiment of the present invention.
Figure 11:
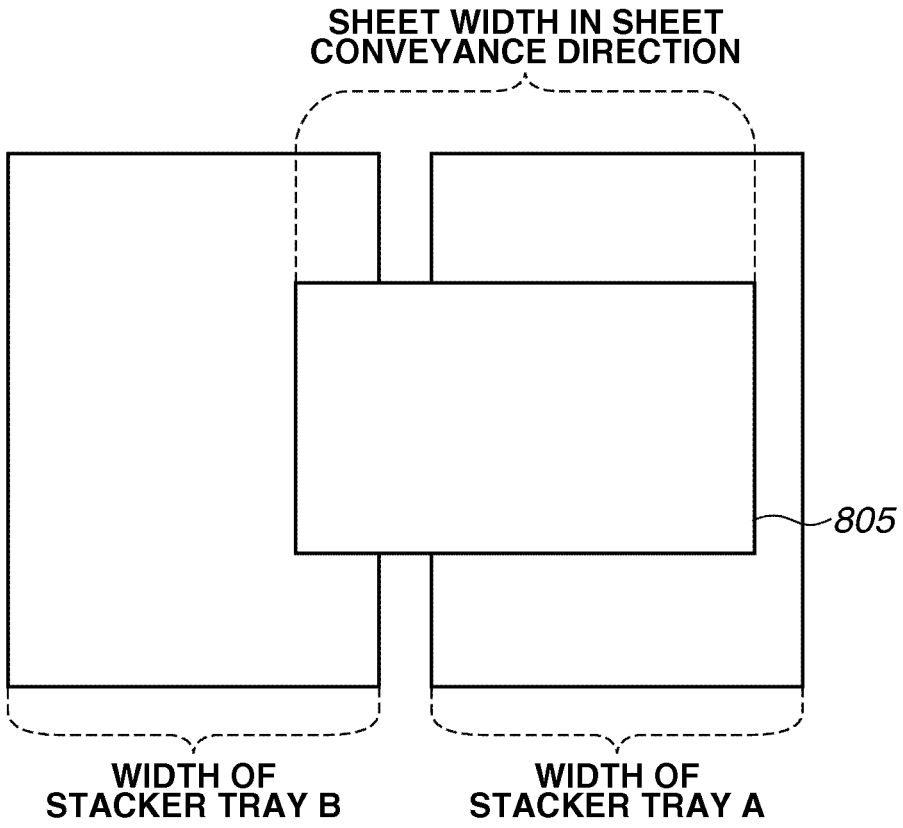
FIG. 11 illustrates stacker trays according to an exemplary embodiment of the present invention.

FIGS. 10 and 11 illustrate the stacker trays A and B of the mass stacker 1 when viewed from the top.

Referring to FIG. 10, a small-size sheet 801 is stacked on the stacker tray A. The width of the sheet 801 in the sheet conveyance direction is smaller than the width of the stacker tray A.

Referring to FIG. 11, a large-size sheet 805 is stacked on the stacker trays A and B. When stacking the large-size sheet 805, the control unit 205 performs control to discharge the sheet 805 to extend over the two stacker trays A and B, as illustrated in FIG. 9.

This stacking method is performed also for the stacker trays C and D of the mass stacker 2.

Figure 12:
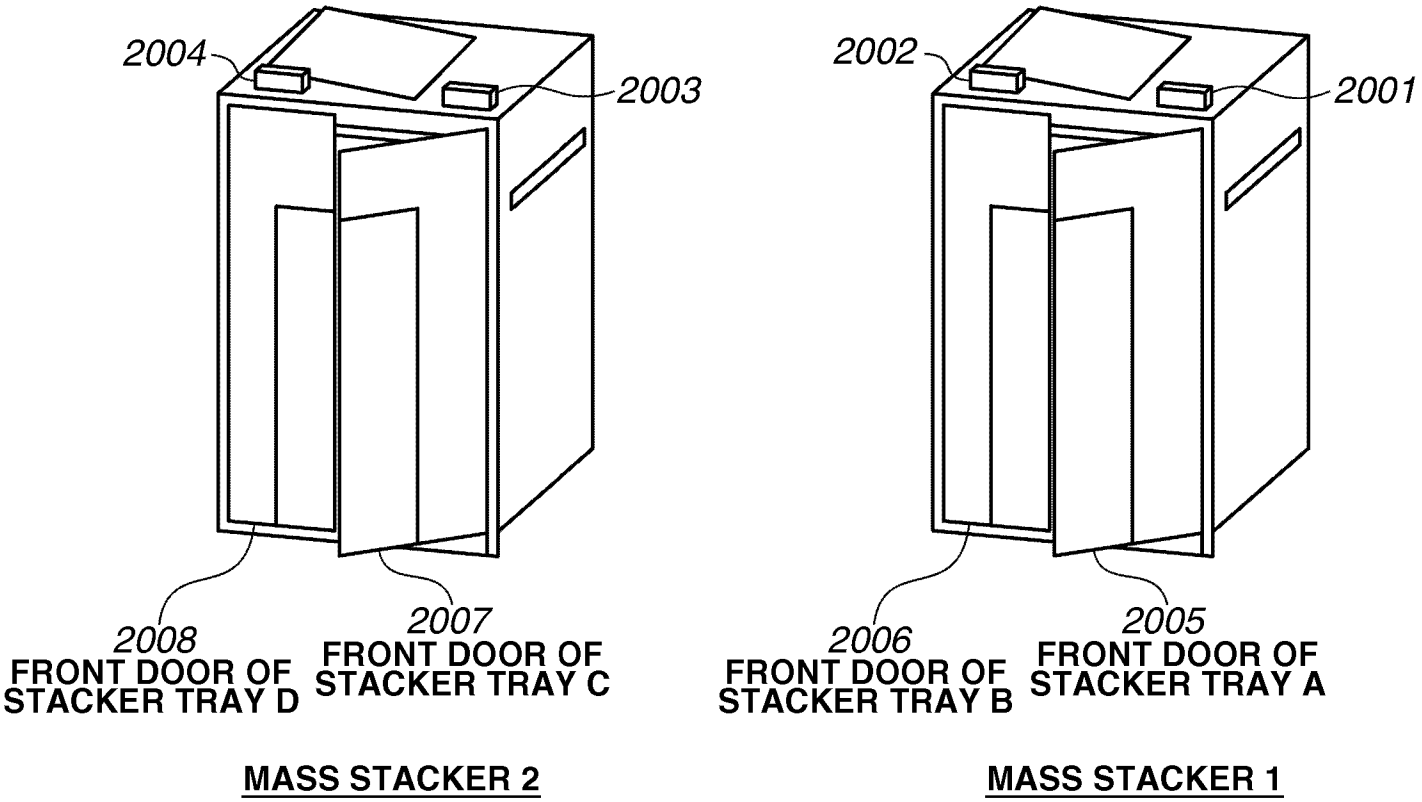
FIG. 12 illustrates appearances of mass stackers according to an exemplary embodiment of the present invention.

FIG. 12 illustrates the appearances of the mass stackers 1 and 2.

The mass stacker 1 is provided with a take-out button for each stacker tray. A take-out button 2001 is used to take out the print products discharged onto the stacker tray A (existing on the right-hand side of the mass stacker 1 illustrated in FIG. 12). When the user presses the take-out button 2001, the stacker tray A is lowered onto the top of the dolly provided at the bottom inside the front doors of the mass stacker 1 and then placed onto the dolly, and a front door 2005 opens.

A take-out button 2002 is used to take out the print products discharged onto the stacker tray B (existing on the left-hand side of the mass stacker 1 illustrated in FIG. 12). When the user presses the take-out button 2002, the stacker tray B is lowered onto the top of the dolly and then placed onto the dolly, and the front doors 2005 and 2006 open.

Subsequently, the user can take out the dolly from the mass stacker 1 and then carry the print products.

In a case where large-size sheets have been stacked on the mass stacker 1 and the user presses either of the take-out buttons 2001 and 2002, both the stacker trays A and B are lowered.

The mass stacker 2 is provided with a take-out button for each stacker tray. A take-out button 2003 is used to take out the print products discharged onto the stacker tray C (existing on the right-hand side of the mass stacker 2 illustrated in FIG. 12). When the user presses the take-out button 2003, the stacker tray C is lowered onto the top of the dolly and then placed onto the dolly, and the front doors 2007 and 2008 open.

The take-out button 2004 is used to take out the print products discharged onto the stacker tray D (existing on the left-hand side of the mass stacker 2 illustrated in FIG. 12). When the user presses the take-out button 2004, the stacker tray D is lowered onto the top of the dolly and then placed onto the dolly, and the front doors 2007 and 2008 open.

In a case where large-size sheets have been stacked on the mass stacker 2 and the user presses either of the take-out buttons 2003 and 2004, both the stacker trays C and D are lowered.

According to an operation received via the operation unit 204, the control unit 205 of the printing system 1000 executes a copy job for reading an image of a document by the scanner unit 201 and printing the read image by the printer unit 203. Then, the control unit 205 applies the sheet processing set on the screen illustrated in FIG. 6 to the sheet having an image printed thereon.

The printing system 1000 executes a print job for receiving print data from the PC 102 and printing an image by the printer unit 203 based on the print data. The print data includes printing settings and image data. The control unit 205 prints the image data according to the print settings.

Figure 13:
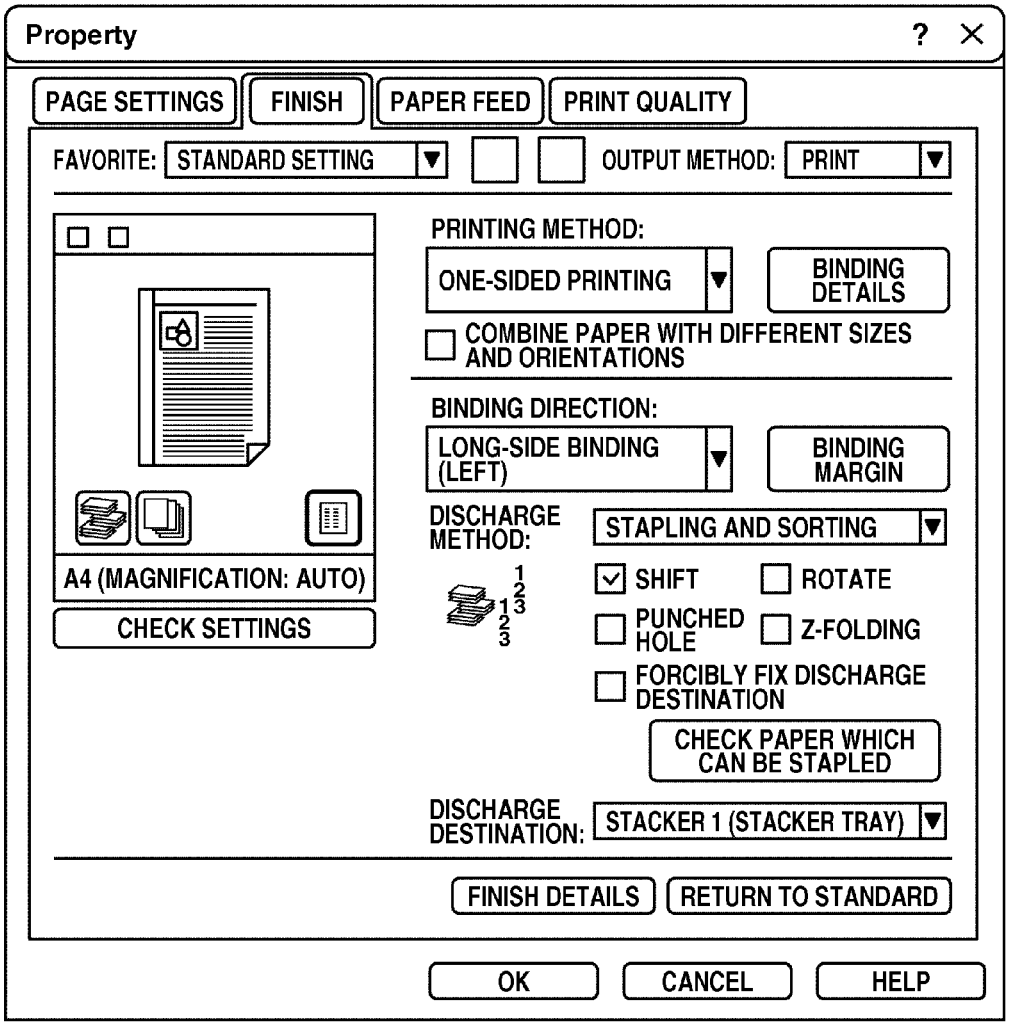
FIG. 13 illustrates a screen of a printer driver according to an exemplary embodiment of the present invention.

The print settings are set by the user via the printer driver illustrated in FIG. 13. This printer driver is displayed on the display unit 109 by the CPU 104 of the PC 102.

When "STACKER 1 (STACKER TRAY)" is selected for the item "SHEET DISCHARGE DESTINATION" and a printing instruction is made, the printer driver generates a print job for discharging print products onto the mass stacker 1, and transmits the print job to the printing system 1000. The printing system 1000 receives a print job specifying the mass stacker 1 and then executes it, whereby sheets are discharged onto the stacker tray A. If sheets of another size have already been stacked on the stacker tray A, or if the stacker tray 331 is tray-full, sheets are discharged onto the stacker tray B.

Otherwise, when "STACKER 2 (STACKER TRAY)" is selected for the item "SHEET DISCHARGE DESTINATION" and a printing instruction is made, the printer driver generates a print job for discharging print products onto the mass stacker 2, and transmits the print job to the printing system 1000.

The printing system 1000 receives a print job specifying the mass stacker 2 and then executes it, whereby sheets are discharged onto the stacker tray C. If sheets of another size have already been stacked on the stacker tray C, or if the stacker tray C is tray-full, sheets are discharged onto the stacker tray D.

As described above, the printing system 1000 has four different stacker trays, and can discharge print products onto each stacker tray. Then, the user can collectively handle print products stacked on each stacker tray. For example, if print products are separately discharged onto a plurality of stacker trays because of tray-full by executing one job, the user needs to get together in the discharge order these print products into one print product afterwards. Further, if these print products are discharged onto different stacker trays by executing different jobs, the user may want to put together in the discharge order these print products for the jobs into one print product afterwards. In this case, however, the user cannot easily know the order in which print products are stacked onto the respective stacking trays.

According to the present invention, therefore, the control unit 205 stores the discharge order of print products discharged onto a plurality of stacker trays, and displays the discharge order. If an automatic sheet take-out instruction is received from the user, the control unit 205 performs sheet take-out processing in the discharge order. The sheet take-out processing refers to processing for lowering a stacker tray, setting it onto the dolly, and opening the front doors for the stacker trays. Thus, the user can easily take out the sheets separately discharged onto the plurality of stacker trays in the discharge order.

Figures 14, 14A:
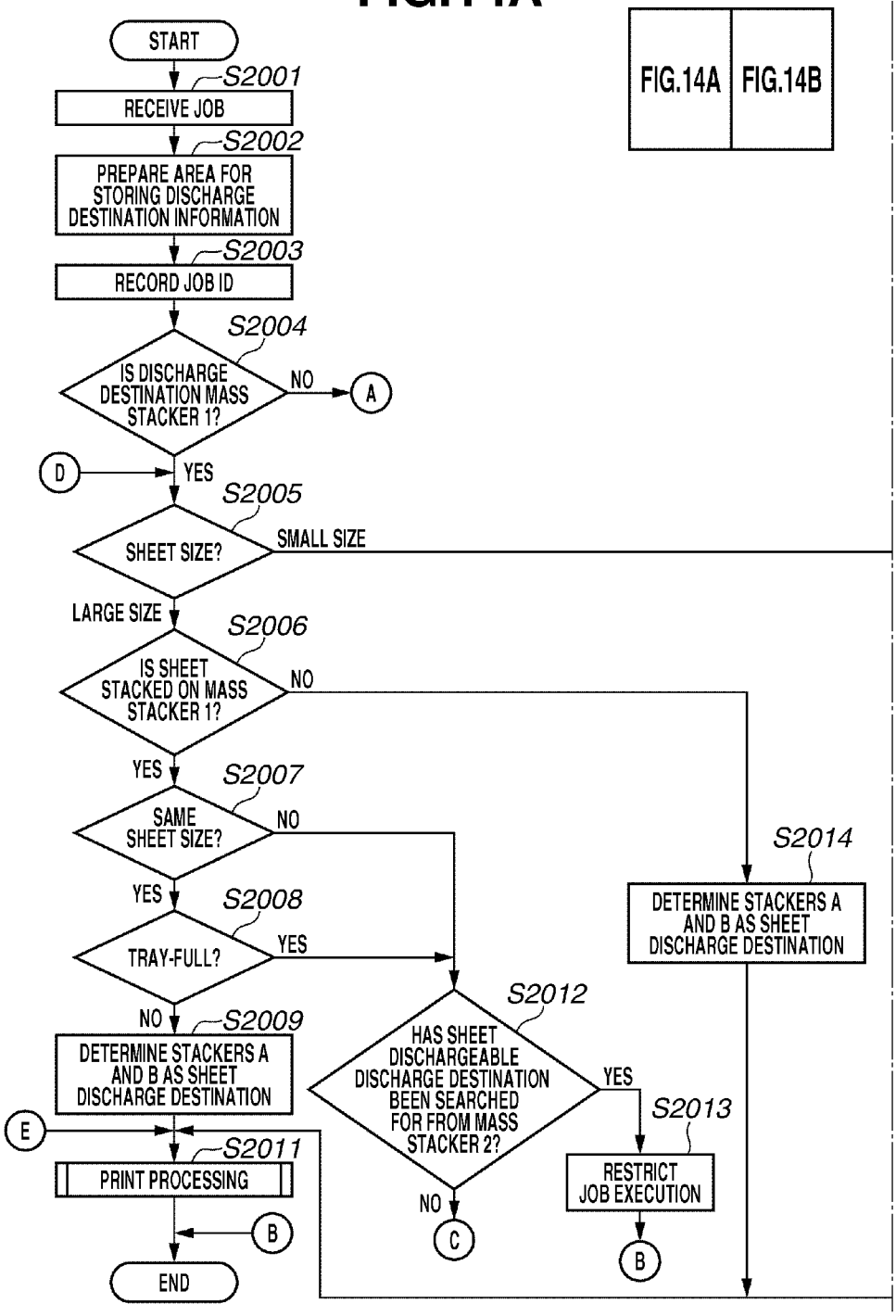
FIG. 14, which is composed of FIG. 14A and FIG. 14B, is a flowchart illustrating processing according to an exemplary embodiment of the present invention.
Figure 14B:
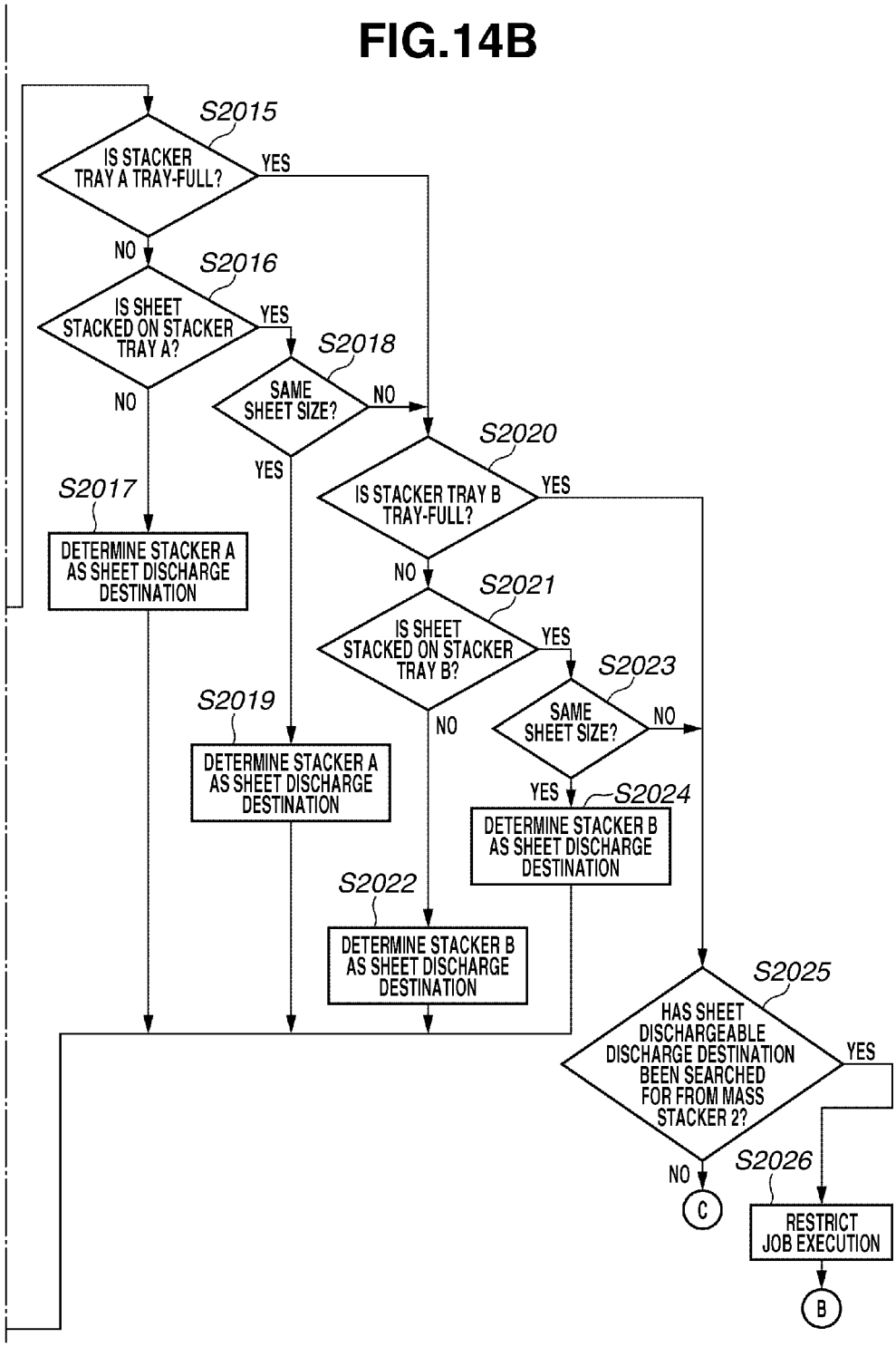
Figures 15, 15A:
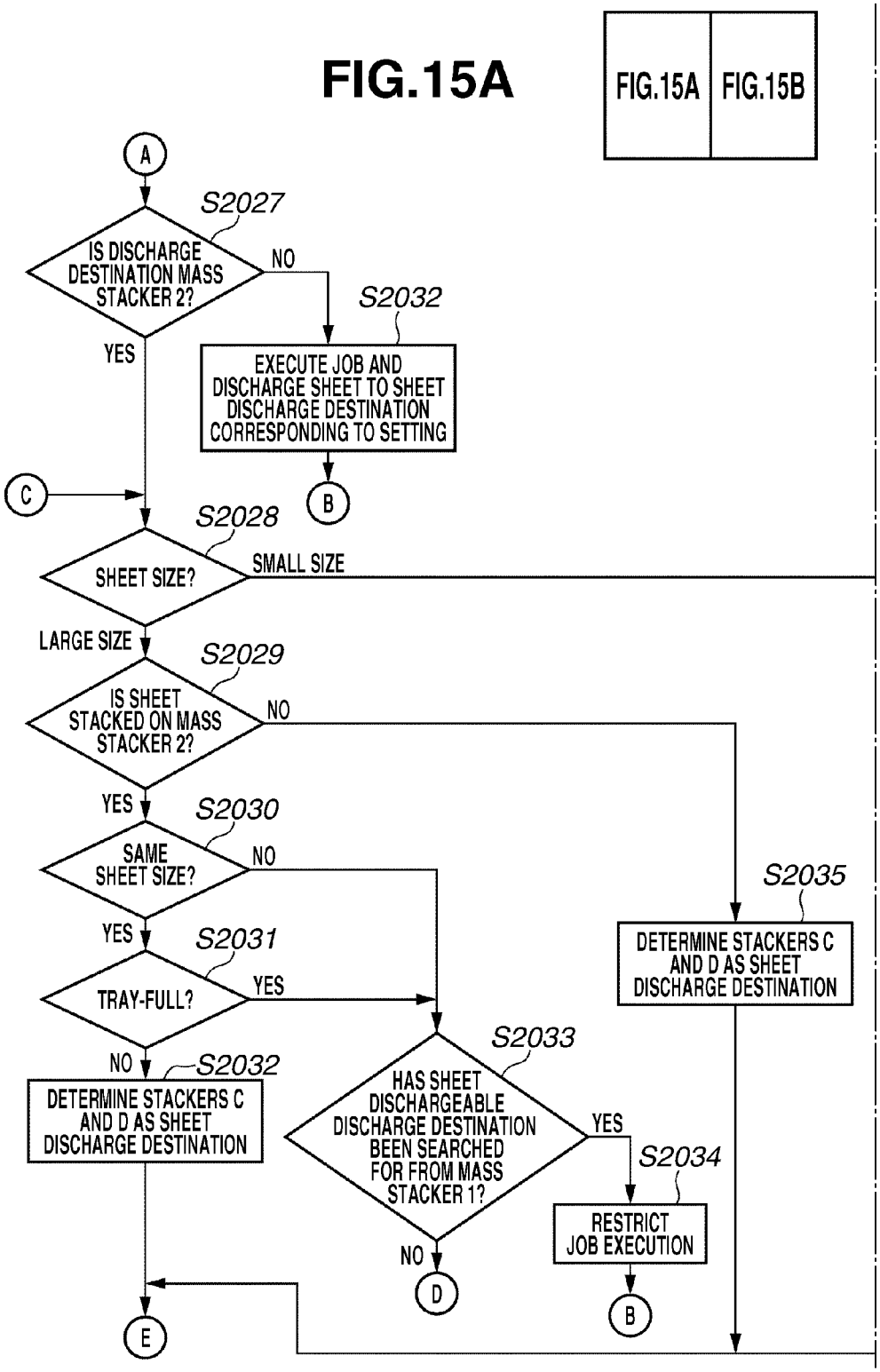
FIG. 15, which is composed of FIG. 15A and FIG. 15B, is a flowchart illustrating processing according to an exemplary embodiment of the present invention.
Figure 15B:
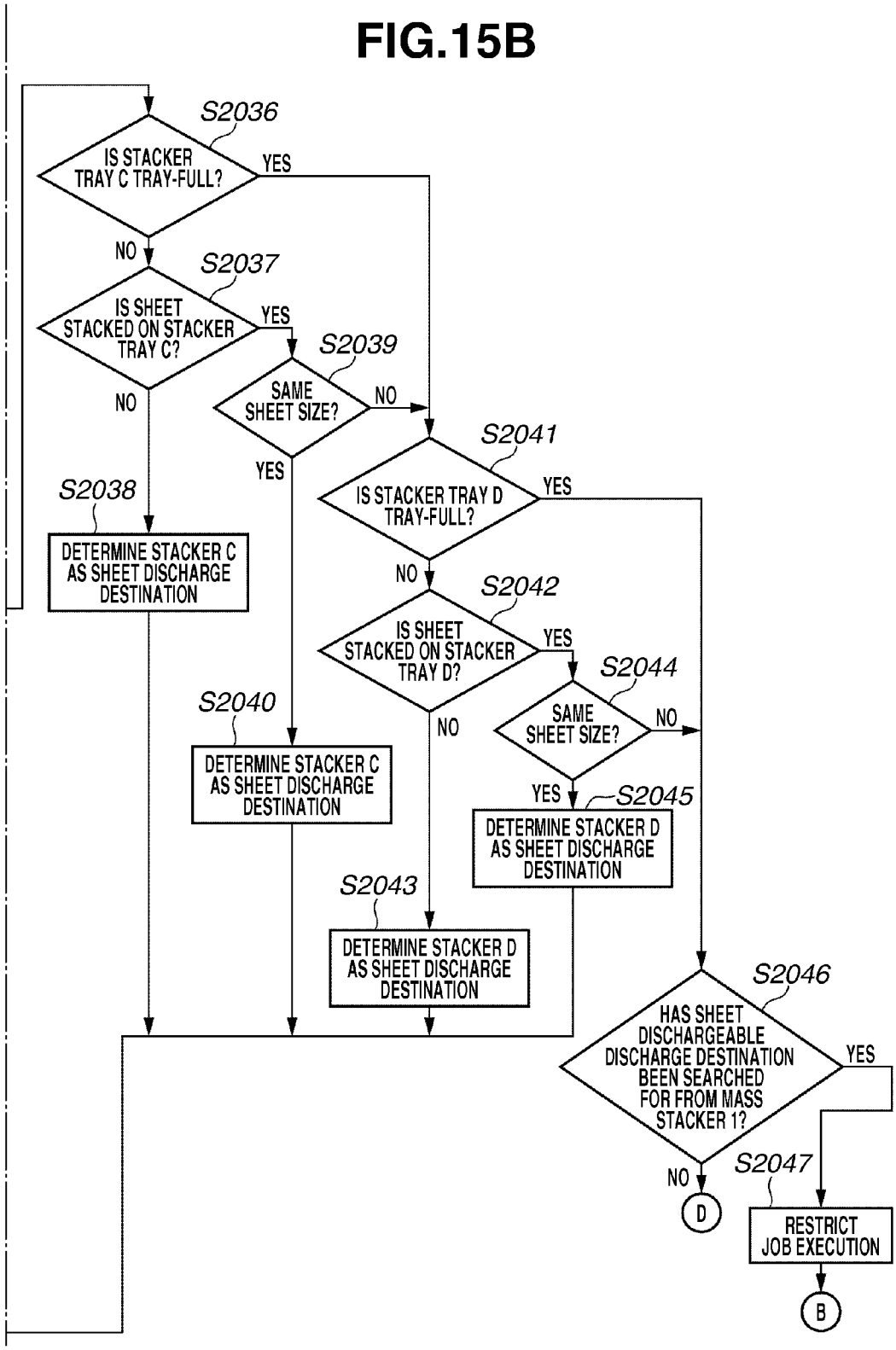

FIGS. 14 and 15 indicate processing for determining the discharge destination performed by the control unit 205. Processing of each step illustrated in the flowchart in FIGS. 14 and 15 is implemented by the control unit 205 reading a program stored in the ROM 207 and then executing it.

In step S2001, the control unit 205 receives a job. For example, the control unit 205 receives settings for a copy job via the operation unit 204.

In this case, the control unit 205 receives a setting for reading a document, a setting for a sheet cassette to be used, a setting for sheet processing, etc., via the operation unit 204, and stores the received setting information in the RAM 208. The sheet cassette to be used may be determined by the user by directly specifying a specific sheet cassette, or determined by the control unit 205 by automatically selecting a sheet cassette based on the document size and the image magnification rate. Then, by the START key 404 being pressed, the control unit 205 starts the copy job based on the received settings.

When a copy job is started, the control unit 205 starts processing for determining a discharge destination based on the sheet stacking status of the stacker trays and the received setting information.

Figure 17A:
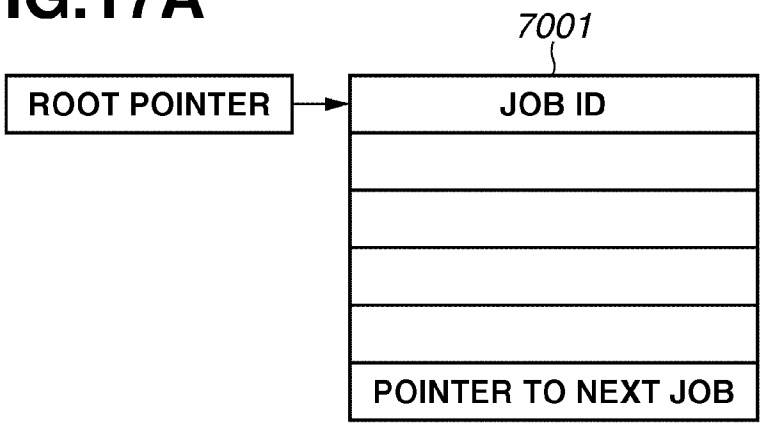
FIGS. 17A and 17B illustrate discharge destination information blocks according to an exemplary embodiment of the present invention.

In step S2002, the control unit 205 prepares a new discharge destination information block in a discharge order management area illustrated in FIG. 17A for the received job. The discharge destination information block includes a job ID for identifying a job, an area for storing the discharge destination of print products for the job in the discharge order, and a pointer for referring to the following discharge destination information block. The control unit 205 further updates the reference destination of a root pointer to a prepared discharge destination information block. If a preceding discharge destination information block exists, the control unit 205 updates the reference destination of a pointer to the preceding discharge destination information block to the prepared discharge destination information block. The discharge order management area illustrated in FIG. 17A is provided in the HDD 209.

In step S2003, the control unit 205 stores the job ID of the job received in step S2001 in the prepared discharge destination information block 7001.

In step S2004, the control unit 205 determines whether the discharge destination of the sheets discharged by executing the job is the mass stacker 1 based on the setting information stored in the RAM 208. If the control unit 205 determines via the screen illustrated in FIG. 6 (YES in step S2004) that the received job is set to perform mass stacking (mass stacker 1), the processing proceeds to step S2005. Otherwise, If the control unit 205 determines that the received job is not set to perform mass stacking (mass stacker 1) (NO in step S2004), the processing proceeds to A (to step S2027 illustrated in FIG. 15).

In step S2005, the control unit 205 determines whether the size of the sheets to be discharged by executing the job is the large size or small size. If the sheet size of the received job is the A4 or B5 size, the control unit 205 determines the sheet size as the small size. If the sheet size of the received job is the A3 or B4 size, the control unit 205 determines the sheet size as the large size. If the control unit 205 determines the sheet size of the received job as the large size (LARGE SIZE in step S2005), the processing proceeds to step S2006. Otherwise, If the control unit 205 determines the sheet size of the received job as the small size (SMALL SIZE in step S2005), the processing proceeds to step S2015.

In step S2006, the control unit 205 determines whether sheets have already been stacked on the mass stacker 1. In determining whether sheets have already been stacked on the mass stacker 1, the control unit 205 uses, for example, a stacking status management table as illustrated in FIGS. 21A, 21B, 21C, and 21D. The stacking status management table is stored in the HDD 209.

FIG. 21A illustrate the stacking status management table If no sheet is stacked onto the stacker trays A to D. Suppose that the control unit 205 subsequently executes a job 1 to discharge A4-size sheets onto the stacker tray C. In this case, the control unit 205 changes PRESENCE OF SHEET for the stacker tray C from "NONE" to "PRESENT", and changes SHEET SIZE from "-" to "A4". The stacking status management table used in this case is illustrated in FIG. 21B.

Suppose that the control unit 205 subsequently executes a job 2 to discharge B5-size sheets onto the stacker tray D. In this case, the control unit 205 changes PRESENCE OF SHEET for the stacker tray D from "NONE" to "PRESENT", and changes SHEET SIZE from "-" to "B5". The stacking status management table in this case is illustrated in FIG. 21C.

Suppose that the control unit 205 further executes a job 3 to discharge A3-size sheets onto both stacker trays A and B. In this case, the control unit 205 changes PRESENCE OF SHEET for the stacker trays A and B from "NONE" to "PRESENT", and changes SHEET SIZE from "-" to "A3". The sheet discharge status management table in this case is illustrated in FIG. 21D.

Each of the stacker tray A to D is provided with a sensor for detecting the presence or absence of stacked sheets. If the relevant sensor detects that no sheet is present, the control unit 205 restores a discharge status table to the state illustrated in FIG. 21A. For example, if the user takes out sheets stacked on the stacker tray A to D, the mass stackers 1 and 2 have no sheet. In this case, the control unit 205 resets the discharge status table to the state illustrated in FIG. 21A based on the sensor information.

In step S2006, the control unit 205 determines whether sheets have already been stacked on the mass stacker by using the above-described stacking status management table.

If the control unit 205 determines that sheets have already been stacked on at least one of the two stacker trays of the mass stacker 1 (YES in step S2006), the processing proceeds to step S2007. Otherwise, if the control unit 205 determines that no sheets have been stacked on the two stacker trays of the mass stacker 1 (NO in step S2006), the processing proceeds to step S2014.

In step S2014, the control unit 205 determines that large-size sheets will be discharged over the two stacker trays A and B of the mass stacker 1 by executing the job. Then, the processing proceeds to step S2011, and the control unit 205 performs print processing. In this case, the same sheets are stacked over the two stacker trays, as illustrated in FIG. 11.

In step S2007, the control unit 205 determines whether the size of the stacked sheets is the same as the size of the sheets to be discharged by executing the job. If the control unit 205 determines that the size of the stacked sheets is the same as the size of the sheets to be discharged by executing the job (YES in step S2007), the processing proceeds to step S2008. Otherwise, if the control unit 205 determines that the size of the stacked sheets is different from the size of the sheets to be discharged by executing the job (NO in step S2007), the processing proceeds to step S2012.

In step S2008, the control unit 205 determines whether the stacker trays A and B are tray-full. The stacker trays A and B are lowered each time sheets are stacked. Therefore, if the tray-full detection sensors illustrated in FIG. 9 detect that the stacker trays A and B are at the lowest position, the control unit 205 determines that the stacker trays A and B are tray-full. If the control unit 205 determines that the stacker trays A and B are tray-full (YES in step S2008), the processing proceeds to step S2012. Otherwise, if the control unit 205 determines that the stacker trays A and B are not tray-full (NO in step S2008), the processing proceeds to step S2009.

In step S2009, the control unit 205 determines that large-size sheets will be discharged onto the large-size sheets already stacked. Then, the processing proceeds to step S2011, and the control unit 205 performs print processing. The reason why the control unit 205 performs control in this way is that the size of the sheets already stacked on the mass stacker (large size) is the same as the size of the sheets to be subsequently discharged and therefore the stacked sheets are assumed to remain stable even after subsequent sheets have been discharged thereon.

In step S2012, the control unit 205 determines whether a dischargeable discharge destination has been searched for from the mass stacker 2. If the control unit 205 determines that a dischargeable discharge destination has not yet been searched for from the mass stacker 2 (NO in step S2012), the processing proceeds to C (to step S2028 illustrated in FIG. 15) to search for a dischargeable discharge destination from the mass stacker 2.

Otherwise, if the control unit 205 determines that a dischargeable discharge destination has already been searched for (YES in step S2012) from the mass stacker 2, the processing proceeds to step S2013.

In step S2013, the control unit 205 saves the job and restricts execution of the job. Since the size (large size) of the sheets already stacked on the mass stacker is different from the size of the sheets to be subsequently discharged, the stacked sheets may become unstable after subsequent sheets have been discharged thereon. Saving the job refers to storing it in a save area of the HDD 209. At this timing, the control unit 205 displays a message "REMOVE SHEETS FROM MASS STACKER" on the operation unit 204. If sheets have been removed from the mass stacker by the user, the control unit 205 executes the saved job and then ends the processing.

The following describes a case where the processing proceeds to step S2015 from step S2005.

In step S2015, the control unit 205 determines whether the stacker tray A is tray-full based on a signal from a relevant tray-full detection sensor. If the control unit 205 determines that the stacker tray A is tray-full (YES in step S2015), the processing proceeds to step S2020. Otherwise, if the control unit 205 determines that the stacker tray A is not tray-full (NO in step S2015), the processing proceeds to step S2016.

In step S2016, the control unit 205 determines whether sheets have already been stacked on the stacker tray A of the mass stacker 1 based on the discharge status table. The control unit 205 takes priority of the stacker tray A over the stacker tray B as a discharge destination candidate because the stacker tray A is less distant from the sheet discharge slot of the stack path than the stacker tray B. If the control unit 205 determines that sheets have not been stacked on the stacker tray A (NO in step S2016), the processing proceeds to step S2017. Otherwise, if the control unit 205 determines that sheets have already been stacked on the stacker tray A (YES in step S2016), the processing proceeds to step S2018.

In step S2017, the control unit 205 determines that sheets will be discharged onto the stacker tray A. Then, the processing proceeds to step S2011, and the control unit 205 performs print processing.

In step S2018, the control unit 205 determines whether the size of the sheets stacked on the stacker tray A is the same as the size of the sheets to be subsequently discharged. If the control unit 205 determines that the size of the sheets stacked on the stacker tray A is the same as the size of the sheets to be subsequently discharged (YES in step S2018), the processing proceeds to step S2019. Otherwise, if the control unit 205 determines that the size of the sheets stacked on the stacker tray A is different from the size of the sheets to be subsequently discharged (NO in step S2018), the processing proceeds to step S2020.

In step S2019, the control unit 205 determines that sheets will be discharged onto the stacker tray A. Then, the processing proceeds to step S2011, and the control unit 205 performs print processing. The reason why the control unit 205 performs control in this way is that the size of the sheets already stacked on the mass stacker A is the same as the size of the sheets to be subsequently discharged and therefore the stacked sheets are assumed to remain stable even after subsequent sheets have been discharged thereon.

In step S2020, the control unit 205 determines whether the stacker tray B is tray-full based on a signal from a relevant tray-full detection sensor. If the control unit 205 determines that the stacker tray B is tray-full (YES in step S2020), the processing proceeds to step S2025. Otherwise, if the control unit 205 determines that the stacker tray B is not tray-full (NO in step S2020), the processing proceeds to step S2021.

In step S2021, the control unit 205 determines whether sheets have already been stacked on the stacker tray B. If the control unit 205 determines that sheets have not been stacked on the stacker tray B (NO in step S2021), the processing proceeds to step S2022. Otherwise, if the control unit 205 determines that sheets have already been stacked on the stacker tray B (YES in step S2021), the processing proceeds to step S2023.

In step S2022, the control unit 205 determines that sheets will be discharged onto the stacker tray B. Then, the processing proceeds to step S2011, and the control unit 205 performs print processing.

In step S2023, the control unit 205 determines whether the size of the sheets stacked on the stacker tray B is the same as the size of the sheets to be subsequently discharged. If the control unit 205 determines that the size of the sheets stacked on the stacker tray B is the same as the size of the sheets to be subsequently discharged (YES in step S2023), the processing proceeds to step S2024. Otherwise, if the control unit 205 determines that the size of the sheets stacked on the stacker tray B is different from the size of the sheets to be subsequently discharged (NO in step S2023), the processing proceeds to step S2025.

In step S2024, the control unit 205 determines that sheets will be discharged onto the stacker tray B. Then, the processing proceeds to step S2011, and the control unit 205 performs print processing.

In step S2025, the control unit 205 determines whether a dischargeable discharge destination has already been searched for from the mass stacker 2. If the control unit 205 determines that a dischargeable discharge destination has not yet been searched for from the mass stacker 2 (NO in step S2025), the processing proceeds to C (to step S2028 illustrated in FIG. 15) to search for a dischargeable discharge destination from the mass stacker 2.

In step S2026, since there is no stackable stacker tray, the control unit 205 saves the job and restricts execution of the job. The control unit 205 displays a message "REMOVE SHEETS FROM MASS STACKER" on the operation unit 204. If sheets have been removed from the mass stacker 2 by the user, the control unit 205 resumes the execution of the job. Thus, the control unit 205 performs control in this way so that a plurality of sheet sizes is not present when stacking small-size sheets onto the stacker tray. Then, the control unit 205 ends the processing.

The following describes a case where processing proceeds to step S2027 from step S2004 with reference to FIG. 15.

In step S2027, the control unit 205 determines whether the discharge destination of the sheets discharged by executing a job is the mass stacker 2 based on the setting information stored in the RAM 208. If the control unit 205 determines via the screen illustrated in FIG. 6 (YES in step S2027) that the received job is set to perform mass stacking (mass stacker 2), the processing proceeds to step S2028. Otherwise, if the control unit 205 determines that the received job is not set to perform mass stacking (mass stacker 2) (NO in step S2027), the processing proceeds to step S2032.

In step S2032, the control unit 205 performs control to discharge sheets onto the discharge destination specified by the job. For example, if the job is set to perform saddle stitch bookbinding, the control unit 205 conveys sheets to the saddle stitch bookbinding machine, and controls the saddle stitch bookbinding machine to perform saddle stitch bookbinding and discharge sheets onto the sheet discharge unit of the saddle stitch bookbinding machine. Otherwise, if the job is not set to performing sheet processing, the control unit 205 conveys sheets to the saddle stitch bookbinding machine, and controls the saddle stitch bookbinding machine to discharge sheets onto the sheet discharge tray 337. Then, the control unit 205 ends the processing.

In step S2028, the control unit 205 determines whether the size of the sheets to be discharged by executing the job is the large size or small size. If the sheet size of the received job is the A4 or B5 size, the control unit 205 determines the sheet size as the small size. If the sheet size of the received job is the A3 or B4 size, the control unit 205 determines the sheet size as the large size. If the control unit 205 determines the sheet size of the received job as the large size (LARGE SIZE in step S2028), the processing proceeds to step S2006. Otherwise, if the control unit 205 determines the sheet size of the received job as the small size (SMALL SIZE in step S2028), the processing proceeds to step S2036.

In step S2029, the control unit 205 determines whether sheets have already been stacked on the mass stacker 2. In determining whether sheets have already been stacked on the mass stacker 2, the control unit 205 uses, for example, the stacking status management table as illustrated in FIGS. 21A, 21B, 21C, and 21D. The stacking status management table is stored in the HDD 209. If the control unit 205 determines that sheets have already been stacked on at least one of the two stacker trays of the mass stacker 2 (YES in step S2029), the processing proceeds to step S2030. Otherwise, if the control unit 205 determines that no sheets have been stacked on the two stacker trays of the mass stacker 2 (NO in step S2029), the processing proceeds to step S2035.

In step S2035, the control unit 205 determines that large-size sheets will be discharged over the two stacker trays C and D of the mass stacker 2 by executing the job. Then, the processing proceeds to step S2011, and the control unit 205 performs print processing. In this case, sheets are stacked over the two stacker trays, as illustrated in FIG. 11.

In step S2030, the control unit 205 determines whether the size of the stacked sheets is the same as the size of the sheets to be discharged by executing the job. If the control unit 205 determines that the size of the stacked sheets is the same as the size of the sheets to be discharged by executing the job (YES in step S2030), the processing proceeds to step S2031. Otherwise, if the control unit 205 determines that the size of the stacked sheets is different from the size of the sheets to be discharged by executing the job (NO in step S2030), the processing proceeds to step S2033.

In step S2031, the control unit 205 determines whether the stacker trays C and D are tray-full based on signals from relevant tray-full detection sensors. The stacker trays C and D are lowered each time sheets are stacked. Therefore, if a tray-full detection sensor illustrated in FIG. 9 detects that the stacker trays C and D are at the lowest position, the control unit 205 determines that the stacker trays C and D are tray-full. If the control unit 205 determines that the stacker trays C and D are tray-full (YES in step S2031), the processing proceeds to step S2033. Otherwise, if the control unit 205 determines that the stacker trays C and D are not tray-full (NO in step S2031), the processing proceeds to step S2032.

In step S2032, the control unit 205 determines that large-size sheets will be discharged onto the large-size sheets already stacked. Then, the processing proceeds to step S2011, and the control unit 205 performs print processing. The reason why the control unit 205 performs control in this way is that the size of the sheets already stacked on the mass stacker (large size) is the same as the size of the sheets to be subsequently discharged and therefore the stacked sheets are assumed to remain stable even after subsequent sheets have been discharged thereon.

In step S2033, the control unit 205 determines whether a dischargeable discharge destination has already been searched for from the mass stacker 1. If the control unit 205 determines that a dischargeable discharge destination has not yet been searched for from the mass stacker 1 (NO in step S2033), the processing proceeds to D (to step S2005 illustrated in FIG. 15) to search for a dischargeable discharge destination from the mass stacker 1.

Otherwise, if the control unit 205 determines that the dischargeable discharge destination has already been searched for from the mass stacker 1 (YES in step S2033), the processing proceeds to step S2034.

In step S2034, the control unit 205 saves the job and restricts the execution of the job. Since the size of the sheets already stacked on the mass stacker (large size) is different from the size of the sheets to be subsequently discharged, the stacked sheets may become unstable after subsequent sheets have been discharged thereon. Saving the job refers to storing it in a save area of the HDD 209. At this timing, the control unit 205 displays a message "REMOVE SHEETS FROM MASS STACKER" on the operation unit 204. If sheets have been removed from the mass stacker 2 by the user, the control unit 205 executes the saved job and then ends the processing.

The following describes a case where processing proceeds to step S2036 from step S2028.

In step S2036, the control unit 205 determines whether the stacker tray C is tray-full based on a signal from a relevant tray-full detection sensor. If the control unit 205 determines that the stacker tray C is tray-full (YES in step S2036), the processing proceeds to step S2041. Otherwise, if the control unit 205 determines that the stacker tray C is not tray-full (NO in step S2036), the processing proceeds to step S2037.

In step S2037, the control unit 205 determines whether sheets have already been stacked on the stacker tray C of the mass stacker 2 based on the discharge status table. The control unit 205 takes priority of the stacker tray C over the stacker tray D as a discharge destination candidate because the stacker tray C is less distant from the sheet discharge slot of the stack path than the stacker tray D. If the control unit 205 determines that sheets have not been stacked on the stacker tray C (NO in step S2037), the processing proceeds to step S2038. Otherwise, if C when the control unit 205 determines that sheets have already been stacked on the stacker tray C (YES in step S2037), the processing proceeds to step S2039.

In step S2038, the control unit 205 determines that sheets will be discharged onto the stacker tray C. Then, the processing proceeds to step S2011, and the control unit 205 performs print processing.

In step S2039, the control unit 205 determines whether the size of the sheets stacked on the stacker tray Cis the same as the size of the sheets to be subsequently discharged. If the control unit 205 determines that the size of the sheets stacked on the stacker tray C is the same as the size of the sheets to be subsequently discharged (YES in step S2039), the processing proceeds to step S2040. Otherwise, if the control unit 205 determines that the size of the sheets stacked on the stacker tray C is different from the size of the sheets to be subsequently discharged (NO in step S2039), the processing proceeds to step S2041.

In step S2040, the control unit 205 determines that sheets will be discharged onto the stacker tray C. Then, the processing proceeds to step S2011, and the control unit 205 performs print processing. The reason why the control unit 205 performs control in this way is that the size of the sheets already stacked on the mass stacker C is the same as the size of the sheets to be subsequently discharged and therefore the stacked sheets are assumed to remain stable even after subsequent sheets have been discharged thereon.

In step S2041, the control unit 205 determines whether the stacker tray D is tray-full based on a signal from a tray-full detection sensor. If the control unit 205 determines that the stacker tray D is tray-full (YES in step S2041), the processing proceeds to step S2046. Otherwise, if the control unit 205 determines that the stacker tray D is not tray-full (NO in step S2041), the processing proceeds to step S2042.

In step S2042, the control unit 205 determines whether sheets have already been stacked on the stacker tray D. If the control unit 205 determines that sheets have not been stacked on the stacker tray D (NO in step S2042), the processing proceeds to step S2043. Otherwise, if the control unit 205 determines that sheets have already been stacked on the stacker tray D (YES in step S2042), the processing proceeds to step S2044.

In step S2043, the control unit 205 determines that sheets will be discharged onto the stacker tray D. Then, the processing proceeds to step S2011, and the control unit 205 performs print processing.

In step S2044, the control unit 205 determines whether the size of the sheets stacked on the stacker tray D is the same as the size of the sheets to be subsequently discharged. If the control unit 205 determines that the size of the sheets stacked on the stacker tray D is the same as the size of the sheets to be subsequently discharged (YES in step S2044), the processing proceeds to step S2045. Otherwise, if the control unit 205 determines that the size of the sheets stacked on the stacker tray A is different from the size of the sheets to be subsequently discharged (NO in step S2044), the processing proceeds to step S2046.

In step S2045, the control unit 205 determines that sheets will be discharged onto the stacker tray D. Then, the processing proceeds to step S2011, and the control unit 205 performs print processing.

In step S2046, the control unit 205 determines whether a dischargeable discharge destination has already been searched for from the mass stacker 1. If the control unit 205 determines that a dischargeable discharge destination has not yet been searched for from the mass stacker 1 (NO in step S2046), the processing proceeds to D (to step S2005 illustrated in FIG. 14) to search for a dischargeable discharge destination from the mass stacker 1.

In step S2047, since there is no stackable stacker tray, the control unit 205 saves the job and restricts the execution of the job. The control unit 205 displays a message "REMOVE SHEETS FROM MASS STACKER" on the operation unit 204. If sheets have been removed from the mass stacker 1 by the user, the control unit 205 resumes the execution of the job. Thus, the control unit 205 performs control in this way so that a plurality of sheet sizes is not present when stacking small-size sheets onto a stacker tray. Then, the control unit 205 ends the processing. The control unit 205 performs control in this way to determine a discharge destination of sheets printed by executing a job.

Figure 16:
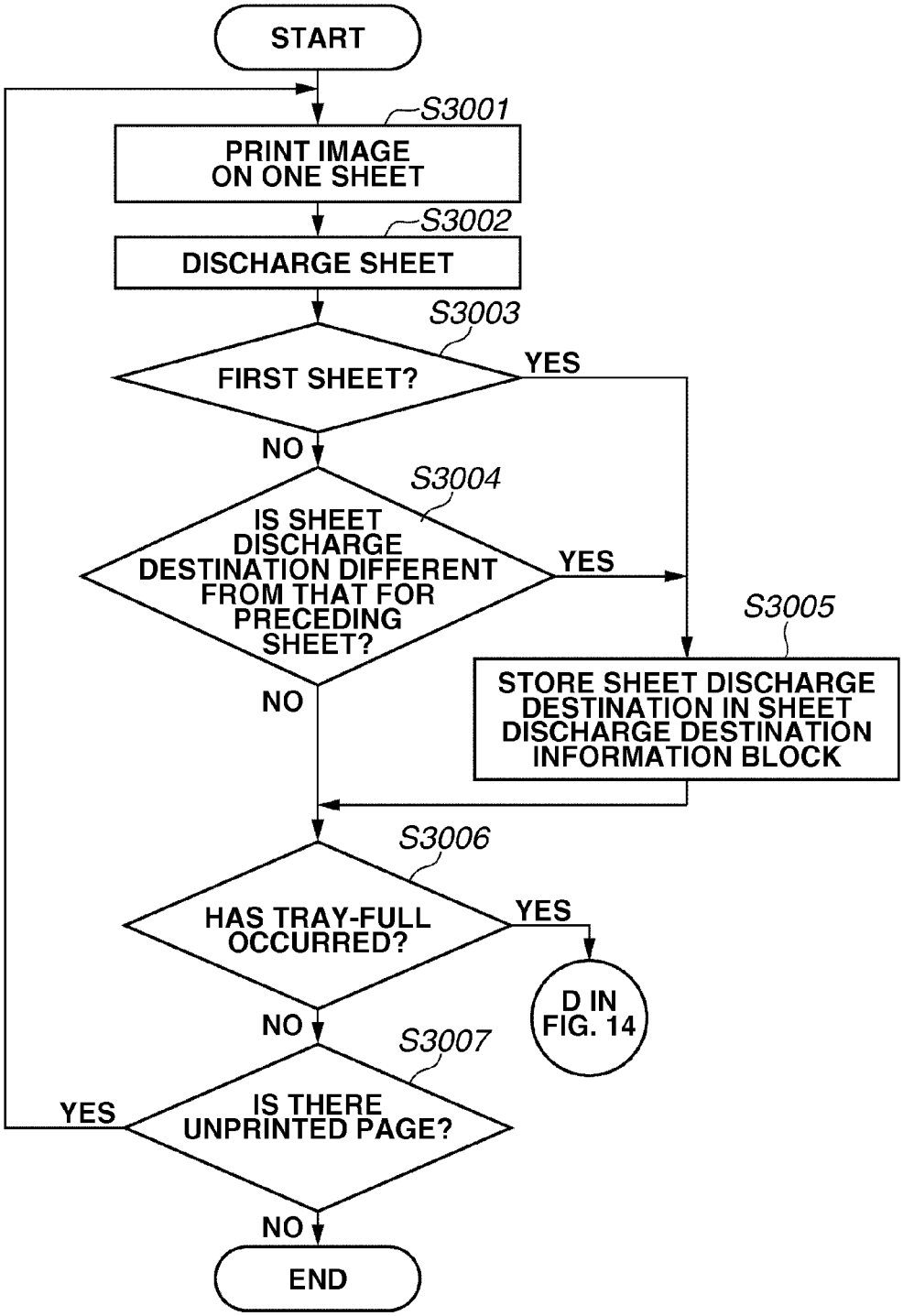
FIG. 16 is a flowchart illustrating processing according to an exemplary embodiment of the present invention.

The following describes the print processing performed in step S2011 with reference to FIG. 16. Processing in each step illustrated in the flowchart in FIG. 16 is implemented by the control unit 205 reading a program stored in the ROM 207 and then executes it.

In step S3001, based on the setting information received in step S2001, the control unit 205 determines a sheet cassette from which sheets will be supplied, and supplies one sheet from the determined sheet cassette. Then, the control unit 205 prints an image on the supplied sheet.

In step S3002, the control unit 205 discharges the sheet having the image printed thereon to the discharge destination determined by the above-described processing.

In step S3003, the control unit 205 determines whether the discharged sheet is the first sheet discharged by executing a job. Specifically, the control unit 205 determines whether the discharged sheet is the first sheet by referring to the value of a counter, provided in the RAM 208, for counting the number of sheets discharged for each job. This counter is reset to zero by the control unit 205 when a job is started. If the control unit 205 determines that the discharged sheet is the first sheet discharged by executing a job (YES in step S3003), the processing proceeds to step S3005. Otherwise, if the control unit 205 determines that the discharged sheet is not the first sheet discharged by executing a job (NO in step S3003), the processing proceeds to step S3004.

In step S3004, the control unit 205 determines whether the discharge destination of the discharged sheet is different from the discharge destination of the sheets previously discharged. If the control unit 205 determines that the discharge destination of the discharged sheet is different from the discharge destination of the sheets previously discharged (YES in step S3004), the processing proceeds to step S3005. Otherwise, if the control unit 205 determines that the discharge destination of the discharged sheet is not different from the discharge destination of sheets previously discharged (NO in step S3004), the processing proceeds to step S3006.

In step S3005, the control unit 205 stores the discharge destination in the discharge destination information block prepared in step S2002. The control unit 205 stores discharge destinations from the top downward in the discharge destination information block to enable recognizing the discharge order for each job.

In step S3006, the control unit 205 determines whether tray-full has occurred in the stacker tray of the discharge destination based on a signal from a relevant tray-full detection sensor. If the control unit 205 determines that tray-full has occurred in the stacker tray of the discharge destination (YES in step S3006), the processing proceeds to D (step S2005 illustrated in FIG. 14) to predetermine a discharge destination of the following sheet. In step S2005, the control unit 205 performs the subsequent processing to determine a discharge destination of the following sheet.

In step S3007, the control unit 205 determines whether there is an unprinted page. If the control unit 205 determines that there is an unprinted page (YES in step S3007), the processing returns to step S3001. Otherwise, if the control unit 205 determines that there is no unprinted page (NO in step S3007), the control unit 205 ends the processing.

Figure 17B:
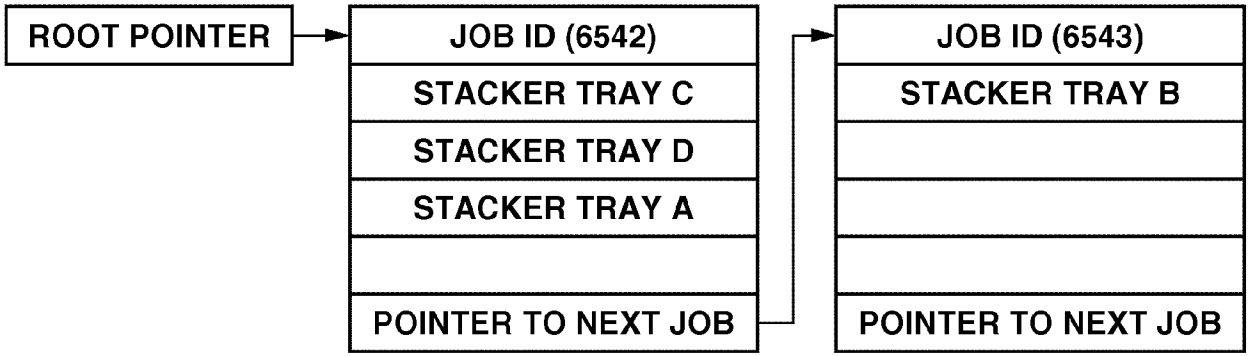

FIG. 17B illustrates the discharge destination information block when the control unit 205 has separately discharged sheets onto a plurality of stacker trays for each job through the above-described processing.

Referring to FIG. 17B, for a job having a job ID "6542", print products have been discharged onto the stacker tray C, the stacker tray D, and the stacker tray A in this order.

After the job having the job ID "6542", a job having a job ID "6543" has been executed. For the job having the job ID "6543", print products have been discharged onto the stacker tray B.

Figure 18:
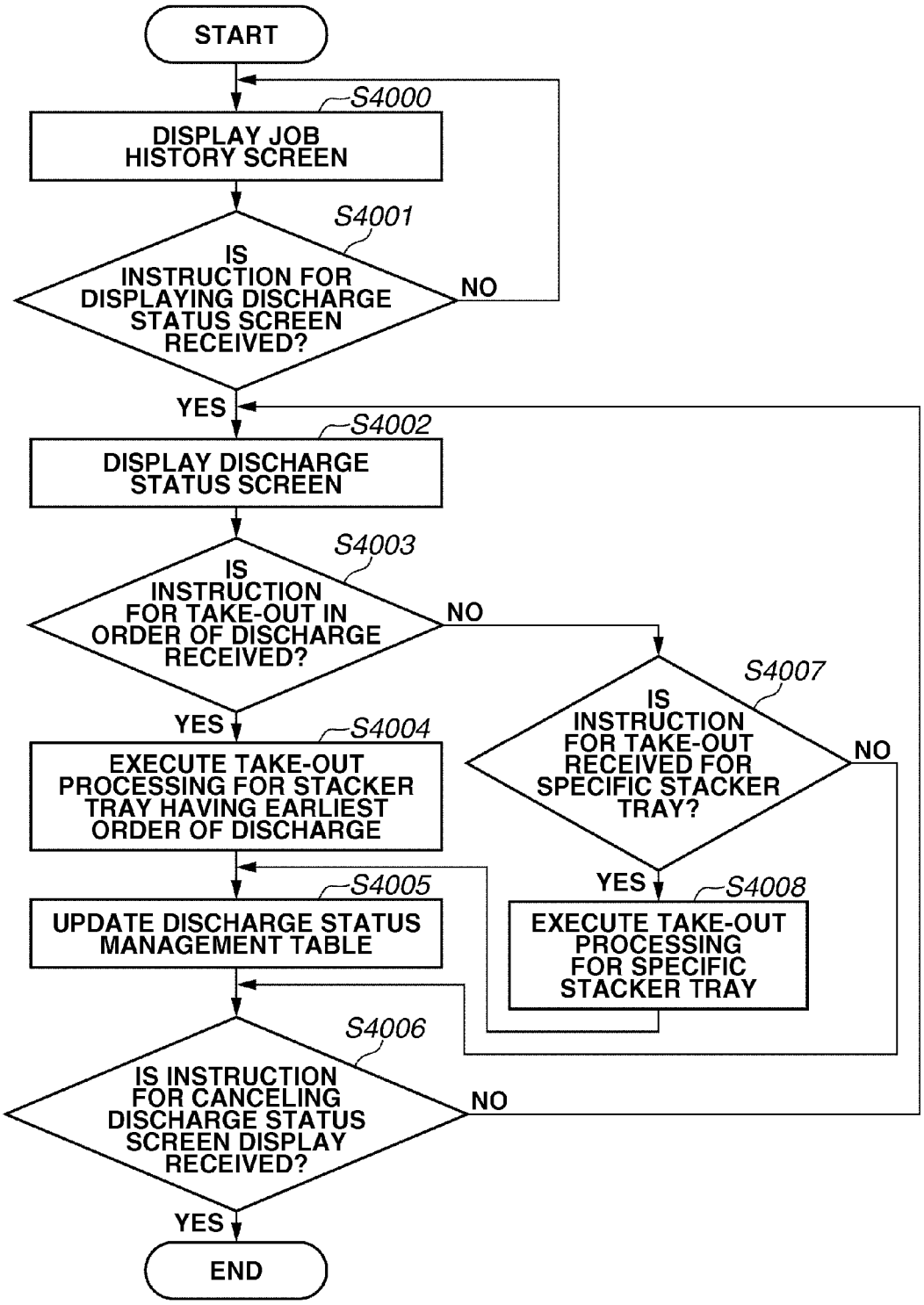
FIG. 18 is a flowchart illustrating processing according to an exemplary embodiment of the present invention.

The following describes processing for taking out sheets with reference to FIG. 18. Processing in each step illustrated in the flowchart in FIG. 18 is implemented by the control unit 205 reading a program stored in the ROM 207 and then executes it.

Figure 19:
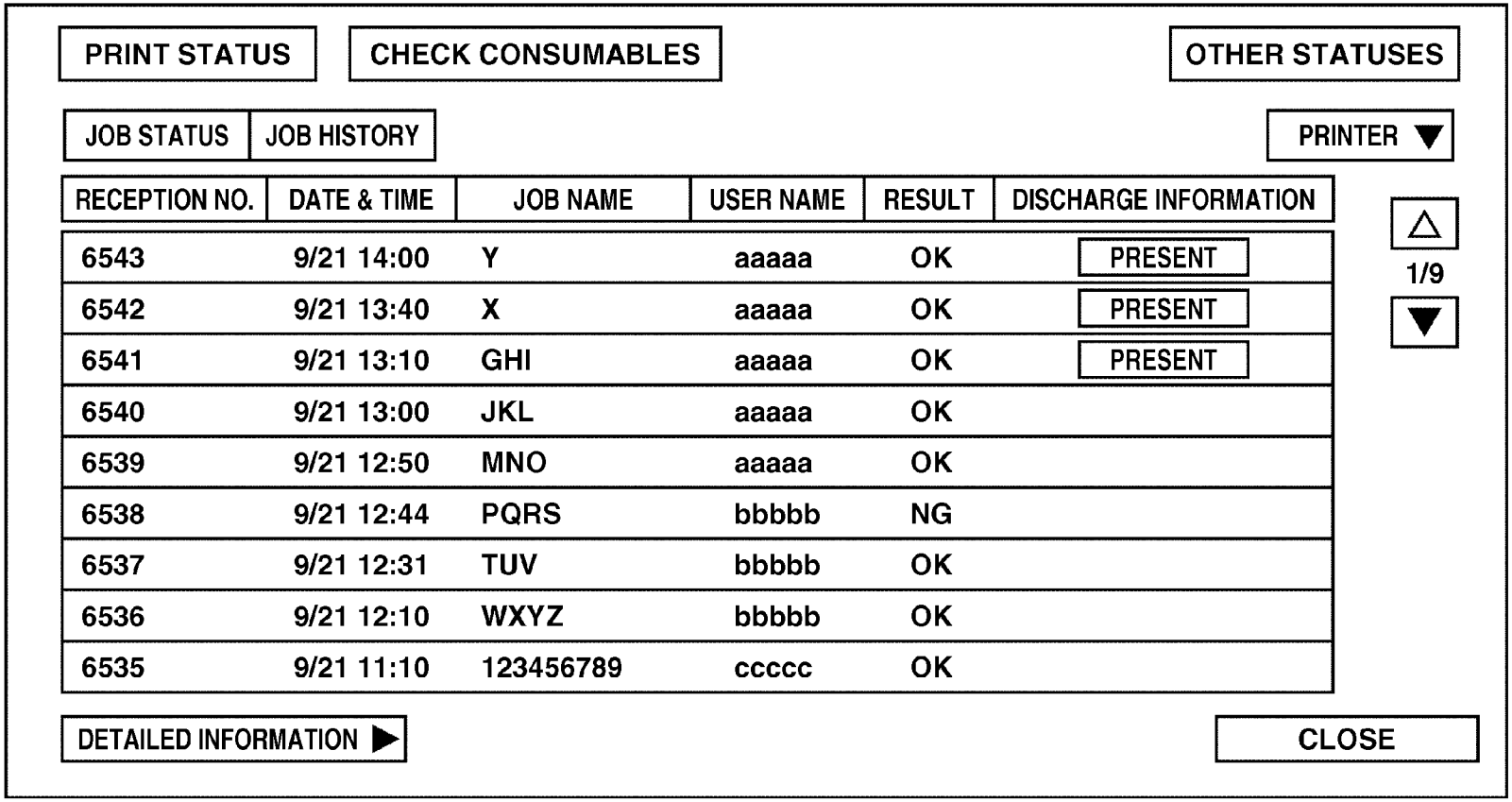
FIG. 19 illustrates a job history screen according to an exemplary embodiment of the present invention.

In step S4000, if the user requests to display a job history screen, the control unit 205 displays the job history screen illustrated in FIG. 19 on the operation unit 204. When executing a job, the control unit 205 stores the job ID (reception number) issued for the job, the date and time of execution of the job, the job name, the user name, and the execution result of the job in the HDD 209, and displays the screen illustrated in FIG. 19 based on the stored information.

The control unit 205 displays a "PRESENT" button in the DISCHARGE INFORMATION column for jobs whose discharge destination information block is stored in the HDD 209.

In step S4001, the control unit 205 determines whether an instruction for displaying the discharge status screen is received from the user. Specifically, the control unit 205 determines whether the "PRESENT" button illustrated in FIG. 19 is pressed. If the control unit 205 determines that the "PRESENT" button illustrated in FIG. 19 is pressed (YES instep S4001), the processing proceeds to step S4002. Otherwise, if the control unit 205 determines that the "PRESENT" button illustrated in FIG. 19 is not pressed (NO in step S4001), the processing returns to step S4000.

Figure 20:
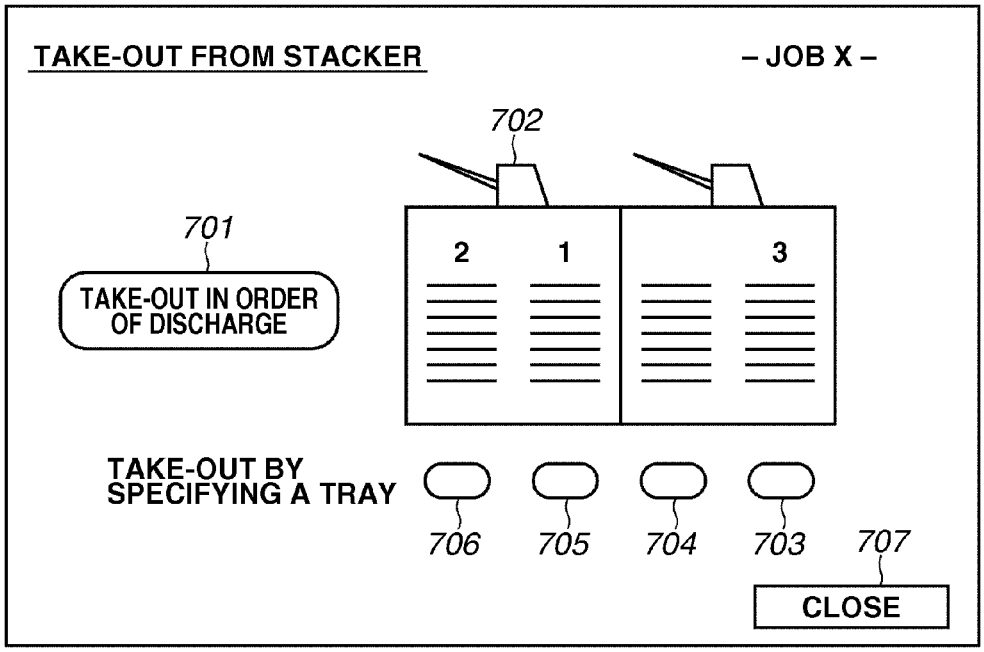
FIG. 20 illustrates a take-out screen according to an exemplary embodiment of the present invention.

In step S4002, the control unit 205 displays the discharge status screen illustrated in FIG. 20 on the operation unit 204. The discharge status screen illustrated in FIG. 20 displays the sheet discharge status of print products of a job whose "PRESENT" button illustrated in FIG. 19 is pressed. The discharge status screen illustrated in FIG. 20 includes a "TAKE-OUT IN ORDER OF DISCHARGE" button 701, an appearance 702 illustrating the appearance of the mass stackers 1 and 2, tray specification buttons 703 to 706, and a CLOSE button 707. The control unit 205 obtains configuration information indicating the configuration of the mass stackers 1 and 2 from memories (not illustrated) included in the mass stackers 1 and 2, respectively, and displays the appearance 702 and the tray specification buttons 703 to 706. The tray specification buttons 703 to 706 correspond to the stacker trays A to D, respectively. The control unit 205 displays the discharge order of print products discharged by executing a job in association with each stacker tray. FIG. 20 illustrate an example screen displayed if the user presses the "PRESENT" button for a job X on the screen illustrated in FIG. 19. If the user presses the "PRESENT" button for the job X on the screen illustrated in FIG. 19, the control unit 205 searches for a discharge destination information block having a job ID "6542" of the job X out of the discharge destination information blocks stored in the HDD 209. Then, based on the information indicating the discharge order stored in the discharge destination information block having the job ID "6542", the control unit 205 displays a number indicating the discharge order on each stacker tray.

In step S4003, the control unit 205 determines whether the user presses the "TAKE-OUT IN ORDER OF DISCHARGE" button 701 on the discharge status screen. If the control unit 205 determines that the user presses the "TAKE-OUT IN ORDER OF DISCHARGE" button 701 (YES in step S4003), the processing proceeds to step S4004. Otherwise, if the control unit 205 determines that the user does not press the "TAKE-OUT IN ORDER OF DISCHARGE" button 701 (NO in step S4003), the processing proceeds to step S4007.

In step S4004, for the job currently displayed on the screen illustrated in FIG. 20, the control unit 205 identifies a stacker tray having the earliest discharge order in the discharge destination information block. Then, the control unit 205 lowers the relevant stacker tray onto the dolly, and opens the front door corresponding to the stacker tray, allowing the user to take out the sheets stacked onto the stacker tray. Then, the processing proceeds to step S4005.

Otherwise, if the processing proceeds to step S4007 from step S4003, the control unit 205 determines whether a take-out instruction is received for a specific stacker tray. Specifically, in step S4007, the control unit 205 determines whether the user presses any one of the tray specification buttons 703 to 706 illustrated in FIG. 20. If the control unit 205 determines that the user presses any one of the tray specification buttons 703 to 706 illustrated in FIG. 20 (YES in step S4007), the processing proceeds to step S4008. Otherwise, if the control unit 205 determines that the user presses none of the tray specification buttons 703 to 706 illustrated in FIG. 20 (NO in step S4007), the processing proceeds to step S4006.

In step S4008, the control unit 205 lowers the stacker tray corresponding to the pressed button onto the dolly, and opens the front door corresponding to the stacker tray, allowing the user take out the sheets stacked on the stacker tray. Then, the processing proceeds to step S4005.

In step S4005, for the job currently displayed on the screen illustrated in FIG. 20, the control unit 205 erases from the discharge destination information block of the job the registration order of the stacker tray from which print products of the job have been taken out.

In step S4006, the control unit 205 determines whether an instruction for canceling display of the discharge status screen is received. Specifically, the control unit 205 determines whether the user presses the "CLOSE" button 707 illustrated in FIG. 20. If the control unit 205 determines that an instruction for canceling display of the discharge status screen is received (YES in step S4006), the control unit 205 ends the processing. Otherwise, if the control unit 205 determines that an instruction for canceling display of the discharge status screen is not received (NO in step S4006), the processing returns to step S4002.

As described above, the control unit 205 stores the discharge order for each stacker tray during execution of print processing. If an instruction for taking out sheets in the discharge order is made, the control unit 205 performs an operation for allowing the user to take out print products in the discharge order. Thus, even without outputting notification sheets, such as inserting sheets indicating the discharge order, the user can take out print products in the discharge order.

Although, in above-described exemplary embodiments, the control unit 205 opens the front door corresponding to a relevant stacker tray in steps S4004 and S4008, the present invention is not limited thereto. For example, the front door may be locked, and, in steps S4004 and S4008, the control unit 205 may unlock the front door so as to be opened and closed. Thus, the user can manually open the front door and take out print products.

Other Exemplary Embodiments

The user can take out print products by pressing the take-out button 2001 or 2002 provided on the mass stacker 1, or the take-out button 2003 or 2004 provided on the mass stacker 2. Also if the user presses any one of these take-out buttons, the control unit 205 lowers the stacker tray corresponding to the pressed take-out button to the dolly. When the control unit 205 opens the front door corresponding to the relevant stacker tray, the user may take out the print products stacked on the stacker tray. In this case, the control unit 205 may or may not erase from each discharge destination information block the registration information of the stacker tray from which sheets have been taken out.

In the above-described exemplary embodiments, upon each reception of the depression of the "TAKE-OUT IN ORDER OF DISCHARGE" button 701 once, the control unit 205 lowers one stacker tray, and opens the front door corresponding to the stacker tray. Specifically, upon reception of the depression of the "TAKE-OUT IN ORDER OF DISCHARGE" button 701 illustrated in FIG. 20 once, the control unit 205 lowers the first stacker tray (a first sheet discharge tray). Upon reception of the depression twice, the control unit 205 lowers the second stacker tray (a second sheet discharge tray), and opens the front door corresponding to each stacker tray. However, the present invention is not limited thereto. Upon reception of the depression of the "TAKE-OUT IN ORDER OF DISCHARGE" button 701 once in the discharge order illustrated in FIG. 20, it may lower two or more stacker trays in which sheets have been discharged by executing the job displayed on the screen illustrated in FIG. 20, and open the front doors corresponding to the two or more stacker trays.

In the above-described exemplary embodiments, sheets are sequentially printed from the first page. When printing sheets in reverse order, i.e., when starting printing from the last page, it is only necessary to sequentially store the discharge order for each job in the discharge destination information block from the bottom upward. Thus, even if reverse order printing is performed, the user can easily take out print products in the page order afterwards.

Further, in the exemplary embodiments, sheets are taken out in the discharge order. However, there may be provided a button for taking out sheets in reverse order from the discharge order for each job. If the user presses the relevant button, the control unit 205 sequentially reads the information indicating the discharge order in the discharge destination information block for a relevant job from the bottom upward, and sequentially lowers the stacker trays and opens the front doors corresponding to the relevant information from the bottom upward. Thus, the user can take out print products in reverse order from the discharge order.

Figure 22:
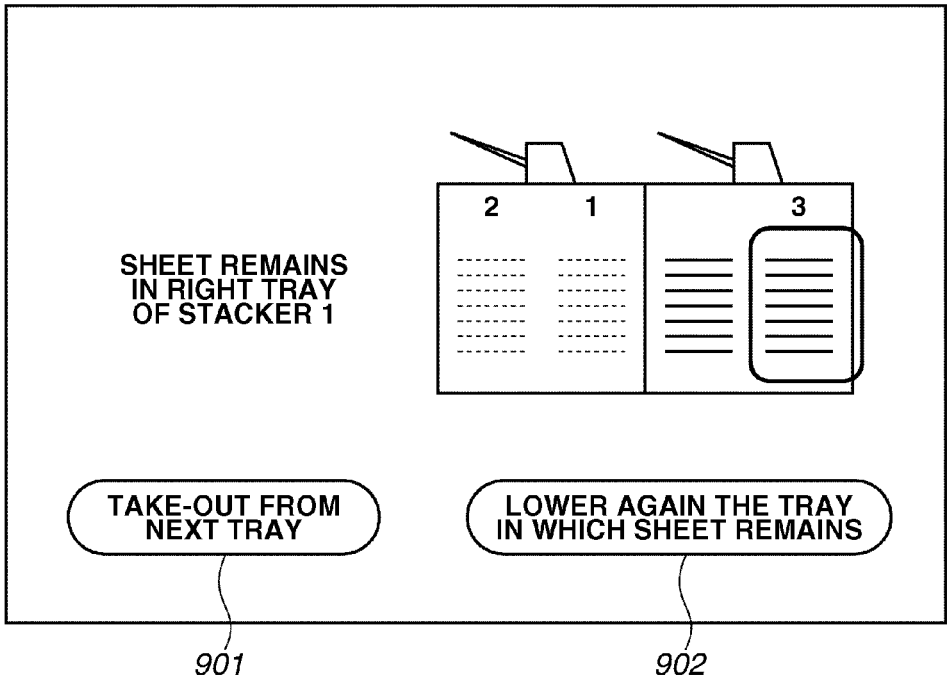
FIG. 22 illustrates a notification screen according to an exemplary embodiment of the present invention.

In the above-described exemplary embodiments, if a print product remains in any stacker tray for which a take-out instruction is made, the page order of print products sequentially took out and combined by the user may be out of sequence. Therefore, if the control unit 205 detects that a front door of amass stacker is closed via a front door open/close detection sensor (not illustrated), the control unit 205 determines whether sheets are present in the stacker tray corresponding to the front door based on a signal from a sheet detection sensor (not illustrated). If the control unit 205 determines that sheets are present, the control unit 205 displays a message as illustrated in FIG. 22 on the operation unit 204. With the screen illustrated in FIG. 22 displayed, the user can easily recognize that a print product remains in a stacker tray and which stacker tray the remaining print product is in.

If the user presses the "TAKE-OUT FROM NEXT TRAY" button 901, the control unit 205 lowers the next stacker tray, ignoring the remaining print product. Otherwise, if the user presses the "LOWER AGAIN THE TRAY IN WHICH SHEET REMAINS" button 902, the control unit 205 lowers again the stacker tray having the remaining print product.

Although, in the above-described exemplary embodiments, each mass stacker is provided with a plurality of stacker trays, the present invention is not limited thereto. The present invention is also applicable to a case where each mass stacker is provided with one stacker tray, and sheets are separately discharged onto these stacker trays.

Although, in the above-described exemplary embodiments, a housing-type apparatus whose inside cannot be seen, such as a mass stacker, is used, the present invention is not limited thereto. For example, the present invention is also applicable to a housing-type apparatus whose inside can be seen, or to an ordinary sheet discharge tray. When applying the present invention to an ordinary sheet discharge tray, it is desirable that, when the user takes out sheets stacked on the sheet discharge tray, the sheet discharge tray is movable, and that sheets discharged on a plurality of sheet discharge trays are moved in the discharge order to a position where the user can easily take out the sheets.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment (s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-134841 filed Jun. 14, 2012, which is hereby incorporated by reference herein in its entirety.

What is claimed is:

1. A sheet processing apparatus for performing control to discharge sheets, the sheet processing apparatus comprising:

a storage unit configured to store, when the sheets are separately discharged onto a plurality of sheet discharge trays, a discharge order among the plurality of sheet discharge trays;

a receiving unit configured to receive a predetermined instruction from a user after discharge of the sheets is completed; and a control unit configured to perform, upon reception of the predetermined instruction, processing for each of the plurality of sheet discharge trays sequentially based on the discharge order stored in the storage unit, the processing enabling the user to take out the discharged sheets.

2. A sheet processing apparatus according to claim 1, wherein, upon reception of the predetermined instruction, the control unit is configured to move each of the plurality of sheet discharge trays to a predetermined position.

3. A sheet processing apparatus according to claim 2, wherein, upon reception of the predetermined instruction once, the control unit is configured to move a first sheet discharge tray having an earliest discharge order out of the plurality of sheet discharge trays, and wherein, upon reception of the predetermined instruction again, the control unit is configured to move a second sheet discharge tray having a second earliest discharge order out of the plurality of sheet discharge trays.

4. A sheet processing apparatus according to claim 1, wherein, upon reception of the predetermined instruction, the control unit is configured to cause covers, each of which corresponds to each of the plurality of sheet discharge trays, to be opened sequentially based on the discharge order stored in the storage unit.

5. A sheet processing apparatus according to claim 1, further comprising a display unit configured to display a screen on which the discharge order is indicated, wherein the receiving unit is configured to receive the predetermined instruction via the screen.

6. A sheet processing apparatus according to claim 1, wherein the sheets corresponds to a plurality of jobs.

7. A sheet processing apparatus according to claim 1, further comprising a notification unit configured to notify, upon detection of a fact that a sheet remains in the sheet discharge tray to which the processing has been applied, the user of the fact.

8. A control method for controlling a sheet processing apparatus for performing control to discharge sheets, the control method comprising:

storing, in a storage unit and when the sheets are separately discharged onto a plurality of sheet discharge trays, a discharge order among the plurality of sheet discharge trays;

receiving a predetermined instruction from a user after discharge of the sheets is completed; and performing, upon reception of the predetermined instruction, processing for each of the plurality of sheet discharge trays sequentially based on the discharge order stored in the storage unit, the processing enabling the user to take out the discharged sheets.

9. A non-transitory computer-readable storage medium storing a computer program to cause a sheet processing apparatus to perform a control method for performing control to discharge sheets, the control method comprising:

storing, in a storage unit and when the sheets are separately discharged onto a plurality of sheet discharge trays, a discharge order among the plurality of sheet discharge trays;

receiving a predetermined instruction from a user after discharge of the sheets is completed; and performing, upon reception of the predetermined instruction, processing for each of the plurality of sheet discharge trays sequentially based on the discharge order stored in the storage unit, the processing enabling the user to take out the discharged sheets.

* * * * *